US005513840A

United States Patent [19]

Fujita et al.

[11] Patent Number: 5,513,840

[45] Date of Patent: May 7, 1996

[54] SHEET PAPER FEEDER FOR TWO-SIDED RECORDING

[75] Inventors: Nobuo Fujita; Sigenori Sasaki; Masato Kawashima, all of Kawasaki, Japan

[73] Assignee: Fujitsu Limited, Kawasaki, Japan

[21] Appl. No.: 104,086

[22] PCT Filed: Dec. 10, 1992

[86] PCT No.: PCT/JP92/01616

§ 371 Date: Aug. 10, 1993

§ 102(e) Date: Aug. 10, 1993

[87] PCT Pub. No.: WO93/12026

PCT Pub. Date: Jun. 24, 1993

[30] Foreign Application Priority Data

| | | | |
|---|---|---|---|
| Dec. 10, 1991 | [JP] | Japan | 3-325858 |
| Dec. 10, 1991 | [JP] | Japan | 3-326200 |
| Apr. 30, 1992 | [JP] | Japan | 4-111012 |

[51] Int. Cl.[6] ..... B65H 39/10

[52] U.S. Cl. ..... 271/301; 271/225; 271/184; 271/185

[58] Field of Search ..... 271/301, 270, 271/902, 291, 186, 225, 184, 185

[56] References Cited

U.S. PATENT DOCUMENTS

| | | | |
|---|---|---|---|
| 4,066,252 | 1/1978 | Wick | 271/186 X |
| 4,579,326 | 4/1986 | Pinckney | 271/902 X |
| 4,692,020 | 9/1987 | Tsujihara | 271/291 X |
| 4,916,493 | 4/1990 | DeVito . | |
| 4,928,128 | 5/1990 | Stemmle | 271/186 X |
| 4,949,949 | 8/1990 | Holmes | 271/902 X |
| 4,990,965 | 2/1991 | Kiya | 271/291 X |

FOREIGN PATENT DOCUMENTS

| | | |
|---|---|---|
| 55-031796 | 3/1980 | Japan . |
| 55-041477 | 3/1980 | Japan . |
| 59-097957 | 6/1984 | Japan . |
| 61-162457 | 7/1986 | Japan . |
| 63-027367 | 2/1988 | Japan . |
| 63-218462 | 9/1988 | Japan . |

*Primary Examiner*—David H. Bollinger
*Attorney, Agent, or Firm*—Staas & Halsey

[57] ABSTRACT

A paper feeder installed in a recording apparatus is capable of selectively performing two-sided recording on sheet paper and includes a paper supply passageway for supplying the sheet paper to a recording unit of the recording apparatus, a paper eject passageway for ejecting from the recording unit the sheet paper on which recording has been performed and a paper bypass passageway which extends between the paper supply passageway and the paper eject passageway. A paper switching unit is provided at a branched portion between the paper eject passageway and the paper bypass passageway. Paper feed rollers can be driven in forward and reverse directions so that the sheet paper can be fed along the paper eject passageway in two directions. The paper feed rollers are arranged on the downstream side of the paper switching unit in the ejection direction of the sheet paper. After the sheet paper on which recording has been performed on one side at the recording unit of the recording apparatus is once fed along the paper eject passageway by the forward direction driving operation of the paper feed rollers, the sheet paper is fed through the paper switching unit to the paper bypass passageway by the reverse direction driving operation of the paper feed rollers, whereby reversal of the sheet paper is carried out.

17 Claims, 18 Drawing Sheets

| |
|---|
| Fig. 11A |
| Fig. 11B |
| Fig. 11C |

SHEET PAPER FEEDER FOR TWO-SIDED RECORDING

TECHNICAL FIELD

The present invention relates to a paper feeder built in a recording apparatus such as a copier or printer, which paper feeder is constituted so as to be able to enable two-sided recording selectively applied to sheet paper.

BACKGROUND ART

In general, a recording apparatus such as a copier or printer is provided with a paper supply cassette holding a stack of sheet paper, a recording unit which performs recording on the sheet paper fed out of the paper supply cassette, and a paper receiver which receives the sheet paper ejected from the recording unit. A paper supply passageway extends between the paper supply cassette and the recording unit, and a paper eject passageway extends between the recording unit and the paper receiver. In short, the sheet paper to be recorded on is introduced from the paper supply cassette to the recording unit through the paper supply passageway, recording is applied to one side of the sheet paper, and this recorded sheet paper is fed to the paper receiver from the recording unit through the paper eject passageway.

Where two-sided recording is applied to sheet paper by such a recording apparatus, after the recording is applied to one side of the sheet paper, it is necessary to reverse that sheet paper and return it to the recording unit. For this reason, in a recording apparatus which can perform two-sided recording, a paper bypass passageway is provided between the paper supply passageway and the paper eject passageway, and a paper switching unit is installed at a branched portion of the paper eject passageway and paper bypass passageway. During one-sided recording, the sheet paper is fed to the paper receiver through the paper eject passageway, but during two-sided recording, the sheet paper is sent to the paper bypass passageway by the paper switching unit. A paper reversal mechanism is installed in the paper bypass passageway, the sheet paper is reversed by the paper reversal mechanism and then introduced again into the recording unit, and thus the recording is applied to the other side of the sheet paper. This sheet paper, that is, the sheet paper subjected to the two-sided recording, is fed from the recording unit to the paper receiver through the eject passageway.

A typical conventional paper reversal mechanism contains a paper reversal and accommodating portion provided midway of the paper bypass passageway, which paper reversal and accommodating portion divides the paper bypass passageway into an upstream part and a downstream part. The paper reversal mechanism further contains a roller assembly installed in the paper reversal and accommodating portion, which roller assembly contains an intermediate roller and two side rollers engaged with this intermediate roller. The intermediate roller is arranged at the branched portion of the upstream part and downstream part of the paper bypass passageway. At this time, one of the two side rollers, that is, a first side roller, is positioned in the upstream part of the paper bypass passageway, and the other side roller, that is, a second side roller, is positioned in the downstream part of the paper bypass passageway. The sheet paper sent through the upstream part of the paper bypass passageway is pulled into the paper reversal and accommodating portion by the first side roller and intermediate roller.

When the rear edge thereof leaves the nip between the first side roller and intermediate roller, the rear edge is grasped by the nip between the second side roller and intermediate roller, whereby the sheet paper is sent to the downstream part of the paper bypass passageway by the second side roller and intermediate roller. Thus, a reversal of the sheet paper is obtained, whereby two-sided recording on the sheet paper becomes possible.

As apparent from the above description, in the conventional paper reversal mechanism, at the time of reversal of the sheet paper, the sheet paper must be completely accommodated in the paper reversal and accommodating portion. In other words, the length of the paper reversal and accommodating portion must correspond to the length of the largest size of sheet paper. For this reason, a recording apparatus having a paper reversal mechanism as mentioned above is enlarged in size due to the paper reversal and accommodating portion thereof.

DISCLOSURE OF THE INVENTION

Accordingly, a main object of the present invention is to provide a paper feeder which is built into a recording apparatus such as a copier or printer and enables selective application of two-sided recording to sheet paper, which paper feeder is constituted so that it can contribute to the reduction of size of the recording apparatus.

Another object of the present invention is to provide a paper feeder as mentioned above which is constituted so that the recording with respect to the sheet paper can be efficiently carried out.

The paper feeder according to the present invention is used for enabling selective performance of two-sided recording on sheet paper by a recording apparatus such as a copier or printer and is provided with a paper supply passageway means for supplying the sheet paper to the recording unit of the recording apparatus; a paper eject passageway means for ejecting from the recording unit the sheet paper on which recording was performed at the recording unit of the recording apparatus; and a paper bypass passageway means which extends between the paper supply passageway means and the paper eject passageway means. According to the present invention, a paper switching means is provided at a branched portion between the paper eject passageway means and the paper bypass passageway means, and a paper feed roller means which can reverse the paper sheet so that the sheet paper can be fed in two directions along the paper eject passageway means is provided in the paper eject passageway means. The paper feed roller means is arranged on the downstream side of the paper switching means in the ejection direction of the sheet paper. At the time of two-sided recording, the sheet paper on which recording was performed on one side at the recording unit of the recording apparatus is once fed along the paper eject passageway means by the forward direction driving operation of the paper feed roller means and is then fed to the paper bypass passageway means through the paper switching means by the reverse direction driving operation of the paper feed roller means, whereby the reversal of the sheet paper is performed.

In the paper feeder according to the present invention, preferably the control of the change-over of the paper feed roller means from the forward direction driving operation to the reverse direction driving operation is carried out by the sheet paper detection means installed in an appropriate portion of the paper eject passageway means based on the detection of the passing of the sheet paper at that portion.

Also, preferably, at the time of two-sided recording, the forward direction driving operation of the paper feed roller means is controlled so that the feeding speed of the sheet paper becomes higher than the usual feeding speed thereof over at least a part of a period where the sheet paper on which recording was performed on one side at the recording unit of the recording apparatus is once fed along the paper eject passageway means by the forward direction driving operation of the paper feed roller means. Further, the reverse direction driving operation of the paper feed roller means is controlled so that the feeding speed of the sheet paper becomes higher than the usual feeding speed thereof over at least a part of a period where the sheet paper is fed to the paper bypass passageway means through the paper switching means by the reverse direction driving operation of the paper feed roller means.

The paper switching means can be constituted as a roller assembly. In this case, that roller assembly preferably comprises a blade-equipped roller element arranged at the branched portion between the paper eject passageway means and the paper bypass passageway means; and two side roller elements which are engaged with this blade-equipped roller element and arranged on the respective sides of the paper eject passageway means and paper bypass passageway means. At this time, the direction of rotation of the blade-equipped roller element is reversed with respect to the direction of rotation of the two side roller elements, but the circumferential speed of these three roller elements is made substantially equal to the usual feeding speed of the sheet paper. On the other hand, the paper switching means can be constituted also only by a blade-equipped roller element arranged at the branched portion between the paper eject passageway means and paper bypass passageway means. In this case, the circumferential speed of the blade-equipped roller element can be made larger than the usual feeding speed of the sheet paper.

BRIEF DESCRIPTION OF THE DRAWINGS

Other objects and other advantages of the present invention will be clarified by the following description with reference to attached drawings wherein.

BEST MODE FOR CARRYING OUT THE INVENTION

Figure 1:
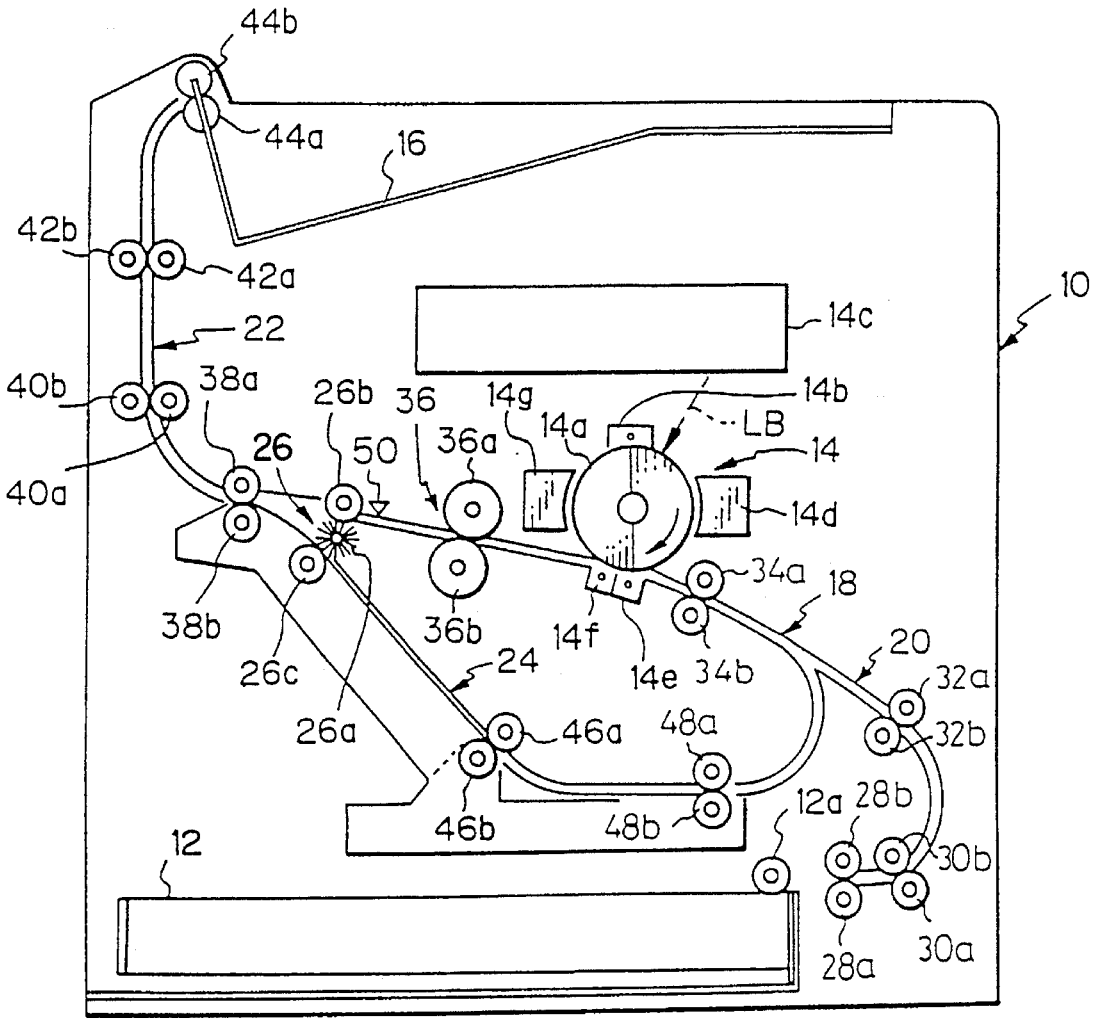
FIG. 1 is a schematic view of a laser printer in which is built a first embodiment of a paper feeder according to the present invention.

Referring to FIG. 1, a laser printer including a paper feeder according to the present invention is schematically shown. The laser printer is provided with a housing 10. A paper supply cassette 12 accommodating the stack of the sheet paper is provided at the bottom portion of this housing 10. Also, in the housing 10, a recording unit, that is, a printing unit 14, is arranged above the paper supply cassette 12. The paper receiver 16 is formed at the top portion of the housing 10. The paper feeder according to the present invention is indicated overall by the reference numeral 18. This paper feeder 18 is provided with a paper supply passageway 20 which extends between the paper supply cassette 12 and the printing unit 14; a paper eject passageway 22 which extends between the printing unit 14 and the paper receiver 16; a paper bypass passageway 24 which extends between the paper supply passageway 20 and the paper eject passageway 22; and a paper switching means 26 arranged at the branched portion between the paper eject passageway 22 and the paper bypass passageway 24. Note that, the paper supply passageway 20, the paper eject passageway 22, and the paper bypass passageway 24 are formed by appropriately arranging the guide plate elements.

The paper supply cassette 12 is provided with a feed out roller 12*a*. The paper sheets are fed out one by one from the stack thereof by this feed out roller 12*a*. Three pairs of paper feed rollers 28*a* and 28*b*, 30*a* and 30*b*, and 32*a* and 32*b* are installed in the paper supply passageway 20 at appropriate intervals. The sheet paper fed out from the paper supply cassette 12 is fed toward the printing unit 14 by three pairs of paper feed rollers, but when the leading edge of the sheet paper reaches one pair of register rollers 34*a* and 34*b*, the sheet paper is temporarily stopped.

Figure 2:
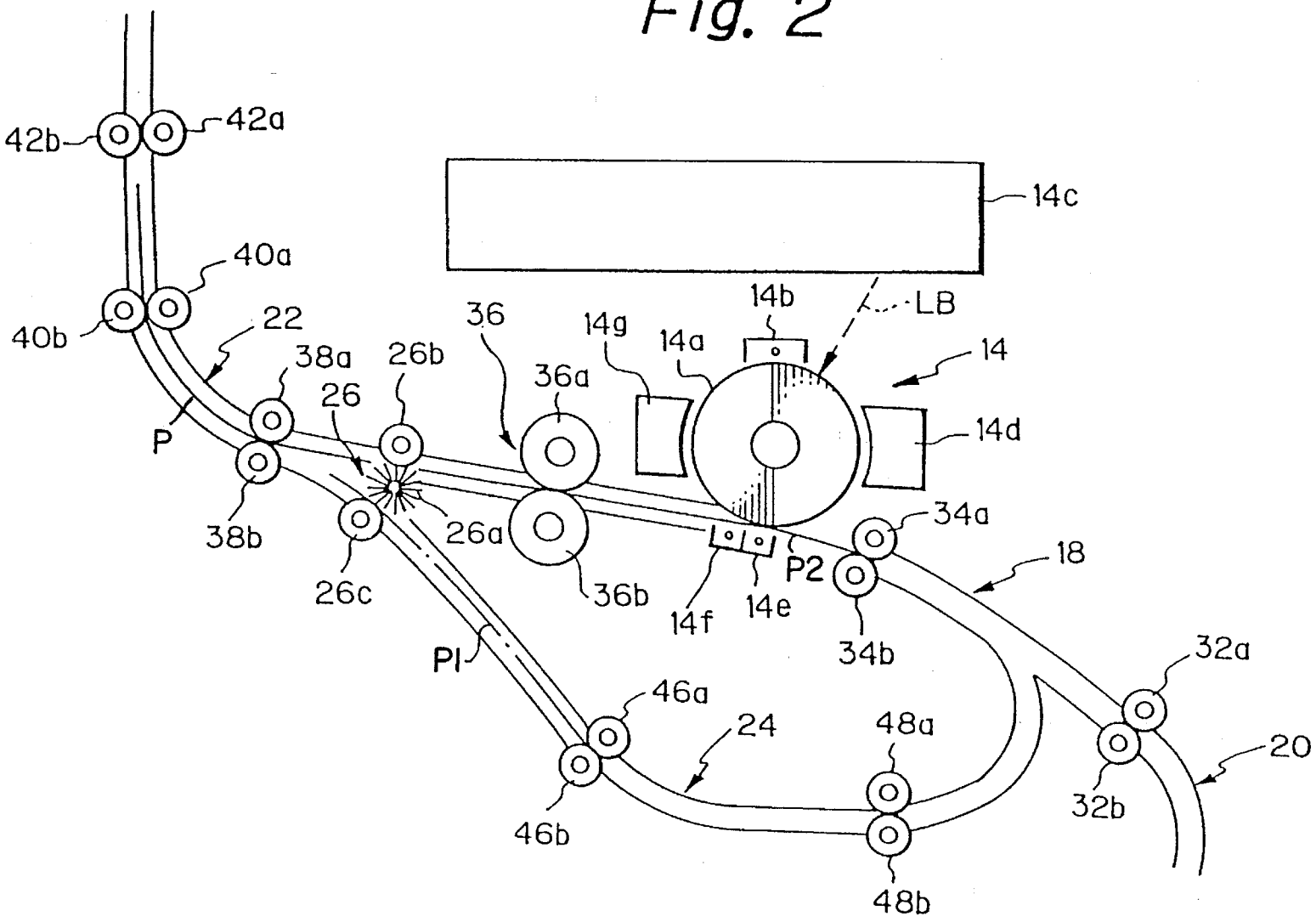
FIG. 2 is a partial enlarged view of the laser printer shown in FIG. 1.

As shown in FIG. 1 and FIG. 2, the printing unit 14 is provided with a photosensitive drum 14*a*. This photosensitive drum is rotated in a clockwise direction at the actuation of the laser printer as indicated by an arrow in FIG. 1. The photosensitive drum 14*a* is formed by forming a photoconductive material layer, that is, a photosensitive material film layer, on the surface of a cylindrical base made of, for example, aluminum. As such a photosensitive material, for example, an organic photosensitive material, a selenium-based photosensitive material, an amorphous silicon photosensitive material, etc. have been known. Electric charges are given to the photosensitive drum 14*a* by an appropriate electric charger, for example a corona charger 14*b*, whereby a uniform charged region is formed in the photosensitive material film layer thereof. An electrostatic latent image is written in the charged region of the photosensitive drum 14a by a laser beam scanning unit 14*c*. The writing of this electrostatic latent image is carried out by repeatedly scanning the laser beam LB emitted from the laser beam scanning unit 14*d* along a longitudinal direction of the photosensitive drum 14*a* and, at the same time, turning on and off the laser beam LB based on binary image data from, for example, a word processor or a microcomputer. The electrostatic latent image written in this way is electrostatically developed as a charged toner image by the developer 14*d*.

The charged toner image is moved toward an appropriate electric charger, for example, a corona charger 14*e*, arranged on the bottom thereof by the rotation of the photosensitive drum 14*a*. On the other hand, a pair of register rollers 34*a* and 34*b* are driven at a predetermined timing to introduce the sheet paper into a gap between the photosensitive drum 14*a* and the corona charger 14*e* at the same speed as the circumferential speed of the photosensitive drum 14*a*. At this time, the corona charger 14*e* gives electric charges having a reverse polarity to that of the charged toner image to the sheet paper, whereby the charged toner image is electrostatically transferred from the photosensitive drum 14*a* to the sheet paper. As mentioned above, a pair of register rollers 34*a* and 34*b* are driven at a predetermined timing, and therefore the transfer of the charged toner image is carried out at a proper position with respect to the sheet paper. An AC discharger 14*f* is arranged adjacent to the corona charger 14*e*. This AC discharger 14*f* removes a part of the electric charges from the sheet paper. For this reason, the electrostatically attraction force acting upon a space between the sheet paper and the photosensitive drum 14*a* is weakened, and thus the winding of the sheet paper around the photosensitive drum 14*a* can be prevented. Note that, in FIG. 1 and FIG. 2, reference numeral 14*g* indicates a toner cleaner. The residual toner remaining on the photosensitive drum 14*a* without transfer to the sheet paper from the photosensitive drum 14*a* is removed by this toner cleaner 14*g*.

As clear from the above description, the circumferential speed of the photosensitive drum 14*a* regulates the printing speed of the laser printer, that is, the feeding speed of the sheet paper. In the present embodiment, the circumferential speed of the photosensitive drum 14*a* is set to 133 mm/sec.

A heat fixing unit 36 is installed in the paper eject passageway 22. The sheet paper ejected from a space between the photosensitive drum 14*a* and AC discharger 14*f* is immediately sent to the heat fixing unit 36, at which the transferred toner image is heat fixed on the sheet paper. Namely, the heat fixing unit 36 comprises a heat roller 36*a* and a backup roller 36*b*. When the sheet paper is passed between them, the transferred toner image is thermally melted and fixed on the sheet paper. Note that, the circumferential speed of the heat roller 36*a* and the backup roller 36*b* is set to the same speed as the circumferential speed of the photosensitive drum 14*a* (that is, the feeding speed of the sheet paper).

Figure 3:
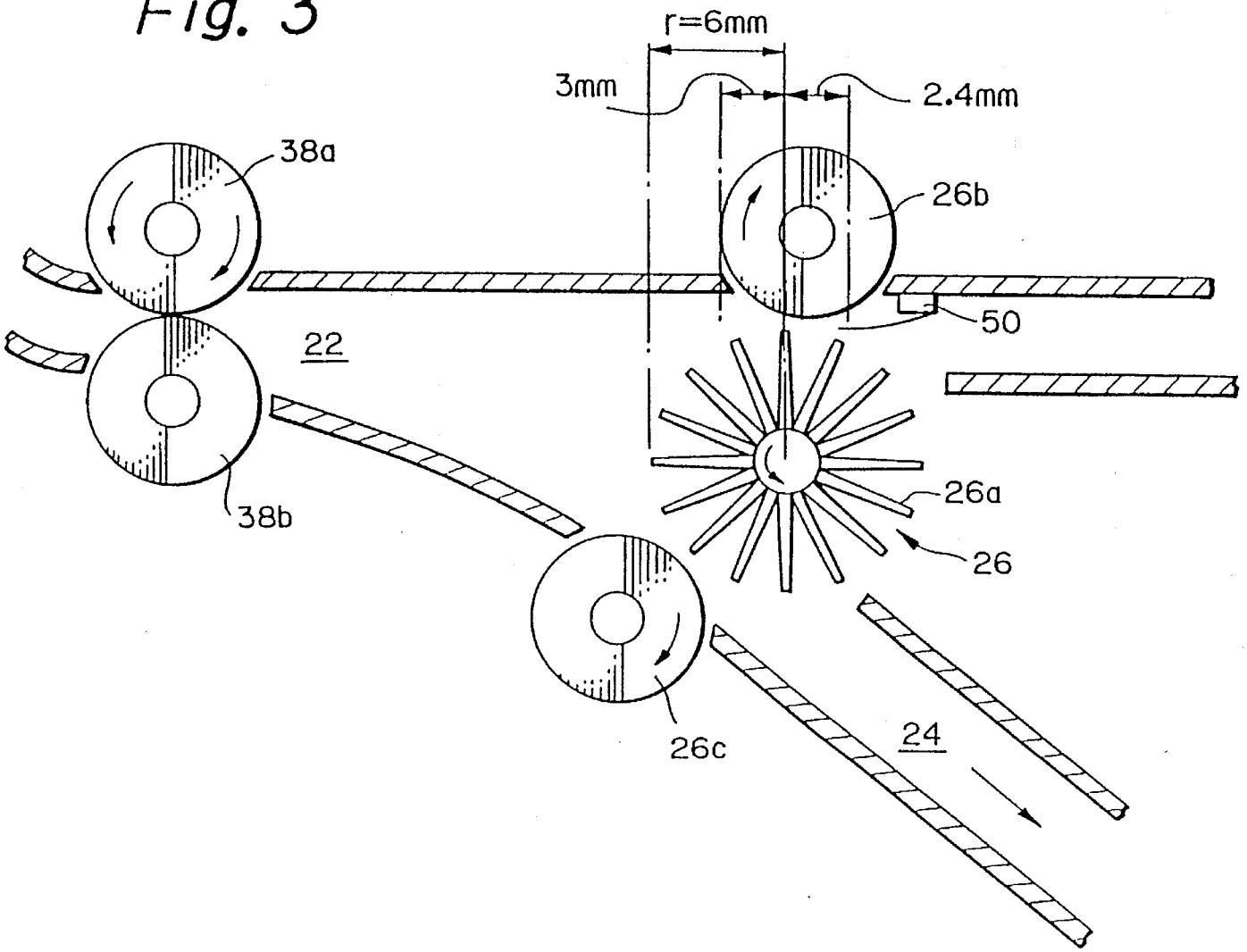
FIG. 3 is a partial enlarged view of the paper feeder shown in FIG. 2.

In the present embodiment, the paper switching means 26 is constituted as a roller assembly comprising three rollers. Namely, the paper switching unit 26 includes the intermediate roller 26*a* arranged at the branched portion between the paper eject passageway 22 and the paper bypass passageway 24. This intermediate roller 26*a* is preferably formed as a blade-equipped roller. The paper switching means 26 further includes the two side rollers 26*b* and 26*c* engaged with the intermediate roller, that is, the blade-equipped roller 26*a*. One side roller, that is, the first side signal roller 26*b*, is installed in the paper eject passageway 22, and the other side roller, that is, the second side roller 26*c*, is installed in the paper bypass passageway 24. The blade-equipped roller 26*a* is formed by embedding a large number of blades in the rotation shaft thereof in the radial direction. Each blade is formed by an appropriate rubber material or a resin material. The blade-equipped roller 26*a* is rotated in the counterclockwise direction as indicated by an arrow in FIG. 3, and the circumferential speed thereof is made the same as the circumferential speed of the photosensitive drum 14*a* (feeding speed of the sheet paper). On the other hand, the first side roller 26*b* and the second side roller 26*c* are rotated in the clockwise direction as indicated by the arrows in FIG. 3, and the circumferential speed thereof is equalized to that of the blade-equipped roller 26*a*. Note that, during the actuation of the laser printer, the three rollers 26*a*, 26*b*, and 26*c* of the paper switching means 26 are always rotated by a main motor (not illustrated) for rotating the photosensitive drum 14*a* of the printing unit 14 and two rollers 36*a* and 36*b* of the heat fixing unit 36 etc.

Three pairs of paper feed rollers 38*a* and 38*b*, 40*a* and 40*b*, and 42*a* and 42*b* are installed in the paper eject passageway 22 at appropriate intervals. The rollers 38*a*, 40*a*, and 42*a* of the pairs of the paper feed rollers are used as the drive rollers, and the other paper feed rollers 30*b*, 40*b*, and 42*b* are used as the driven rollers. The drive rollers 38*a*, 40*a*, and 42*a* are simultaneously rotated by the same drive source, for example, a step motor (not illustrated in FIG. 1 and FIG. 2) at the same circumferential speed as the circumferential speed of the photosensitive drum 14*a* (feeding speed of the sheet paper). The driving operation of the step motor can be reversed. Namely, the drive roller 38*a* (40*a*, 42*a*) may be rotated in both of the clockwise direction and counterclockwise direction as indicated by the two arrows in FIG. 3. Here, for convenience of the latter explanation, when the abovementioned step motor is driven to rotate the drive roller 38*a* (40*a*, 42*a*) in the clockwise direction, that driving direction is defined as the forward direction, and when the abovementioned step motor is driven to rotate the drive roller 38*a* (40*a*, 42*a*) in the center clockwise direction, that driving direction is defined as the reverse direction. Note that, a pair of paper eject rollers 44*a* and 44*b* are provided at the outlet end of the paper eject passageway 22.

As shown in FIG. 1, two pairs of paper feed rollers 46*a* and 46*b* and 48*a* and 48*b* are installed also in the paper bypass passageway 24 at appropriate intervals. The rollers 46*a* and 48*a* in the pairs of paper feed rollers are used as the drive rollers, and the other paper feed rollers 46*b* and 48*b* are used as the driven rollers. The drive rollers 46*a* and 48*a* are always rotated in only one direction by the same drive source, for example, a step motor (not illustrated in FIG. 1 and FIG. 2) at the circumferential speed of the photosensitive drum 14*a* (feeding speed of the sheet paper). Namely, according to the abovementioned definition, the drive rollers 46*a* and 48*a* are always rotated only in the reverse direction (counterclockwise direction).

As shown in FIG. 1, an appropriate paper detector 50 is installed in the paper eject passageway 22. This paper detector 50 is arranged on the heat fixing unit 36 side close to the first side roller 26*b* of the paper switching means 26. By such a paper detector 50, the leading edge and trailing edge of the sheet paper ejected from the heat fixing unit 36 are detected. As clear from FIG. 3, in the present embodiment, a lever actuation type microswitch is used as the paper detector 50. Another type of detector also, for example, an optical sensor can be used as the paper detector 50.

Figure 4:
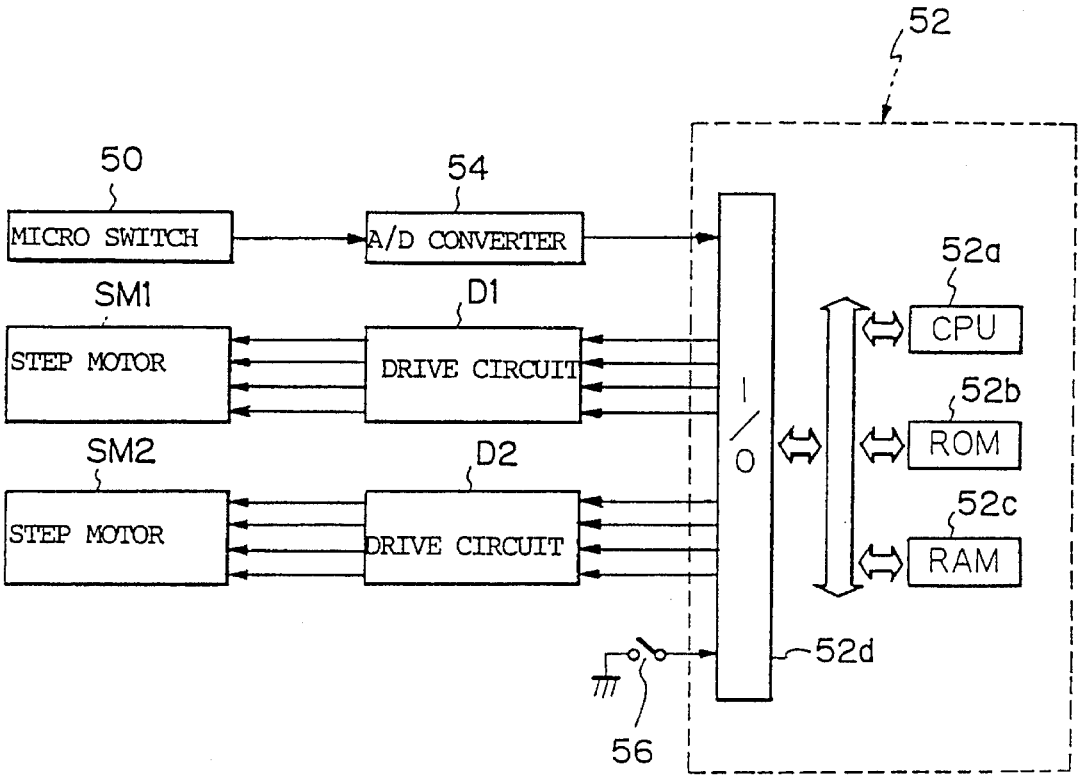
FIG. 4 is a control block diagram of the paper feeder shown in FIG. 2.

The paper feeder according to the present invention is provided with a control circuit 52 as shown in FIG. 4. This control circuit is constituted by a microcomputer. As illustrated, the microcomputer includes a central processing unit (CPU) 52*a*, a read only memory (ROM) 52*b* storing an actuation program, constants, etc., a random access memory (RAM) 52*c* storing temporary data etc., and an input/output interface (I/O) 52*d*.

The paper detector, that is, the microswitch 50, is connected via an A/D converter 54 to the I/O 52*d* of the control circuit 52. When the lever of the microswitch 50 is pushed in contact with the sheet paper, the output signal from the A/D converter 54 is brought to a low level "L", and in a case other than this, the output signal from the A/D converter 54 is brought to a high level "H". In short, at the passing of the sheet paper at the position of deployment of the microswitch 50, when the leading edge of the sheet paper comes into contact with the lever of the microswitch 50, the output signal from the A/D converter 54 is changed over from the high level "H" to the low level "L", and when the trailing edge of the sheet paper leaves the lever of the microswitch 50, the output signal from the A/D converter 54 is changed over from the low level "L".

The step motor SM1 is the motor for driving the three drive rollers 38*a*, 40*a*, and 42*a* installed in the paper eject passageway 22. These drive rollers are simultaneously rotated by the step motor SM1 via an appropriate drive transfer means, for example, a belt or a gear train. Also, the step motor SM2 is the motor for driving the drive rollers 46*a* and 48*a* installed in the paper bypass passageway 24. These drive rollers are also simultaneously rotated by the step motor SM2 via an appropriate drive transfer means. The step motors SM1 and SM2 are connected via the drive circuits D1 and D2, respectively, to the I/O 52*d*. The respective drive circuits D1 and D2 are controlled by the control signal prepared by the control circuit, that is, the microcomputer 52, whereby the drive pulse is output from the respective drive circuits D1 and D2 to the related step motors SM1 and SM2. Note that, it is well known to have the turning on/off, acceleration, deceleration, and reverse driving of the step motor controlled by a microcomputer.

Figure 5A:
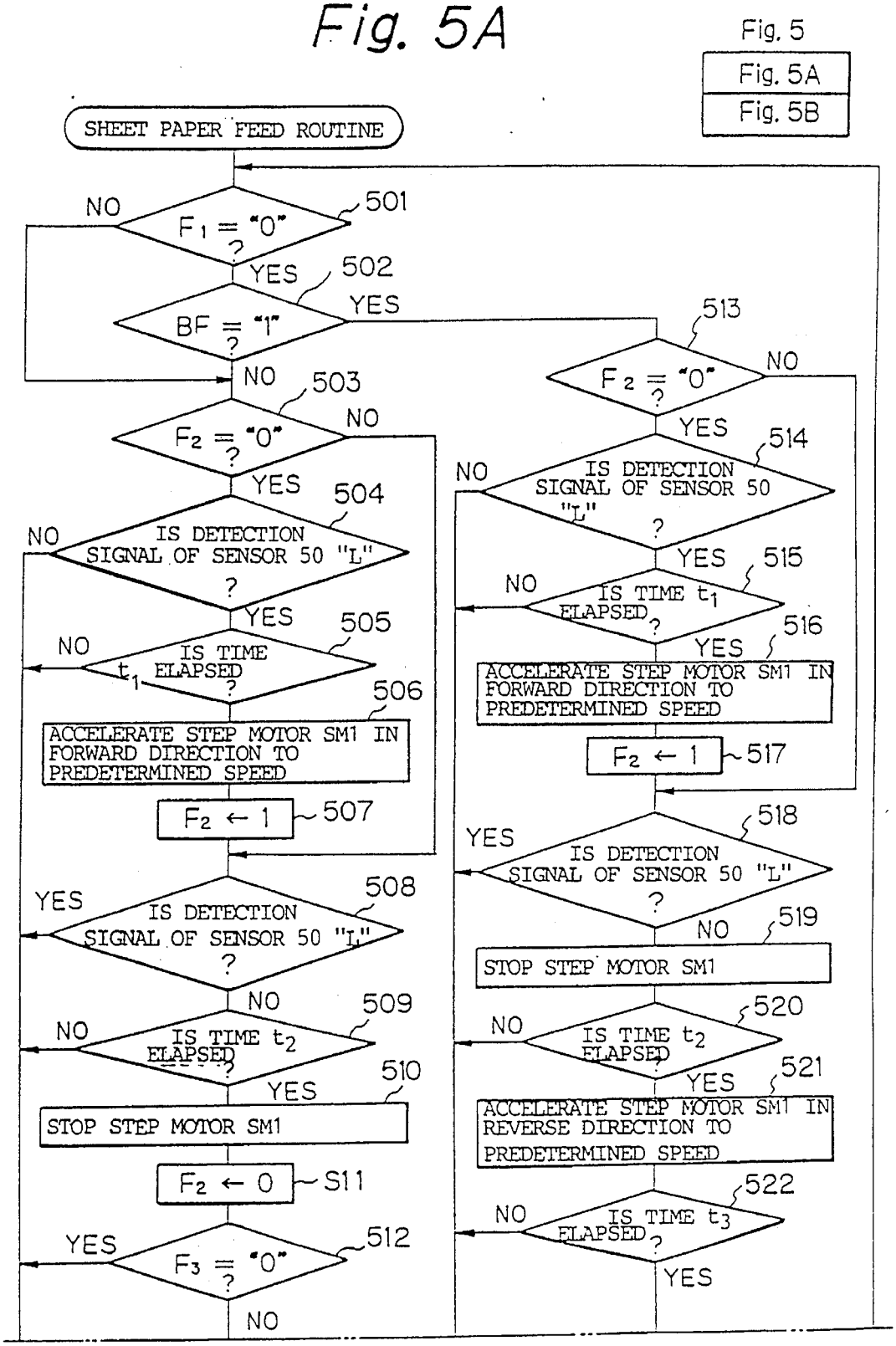
FIGS. 5A and 5B are a flow chart explaining the actuation of the paper feeder shown in FIG. 2.
Figure 5B:
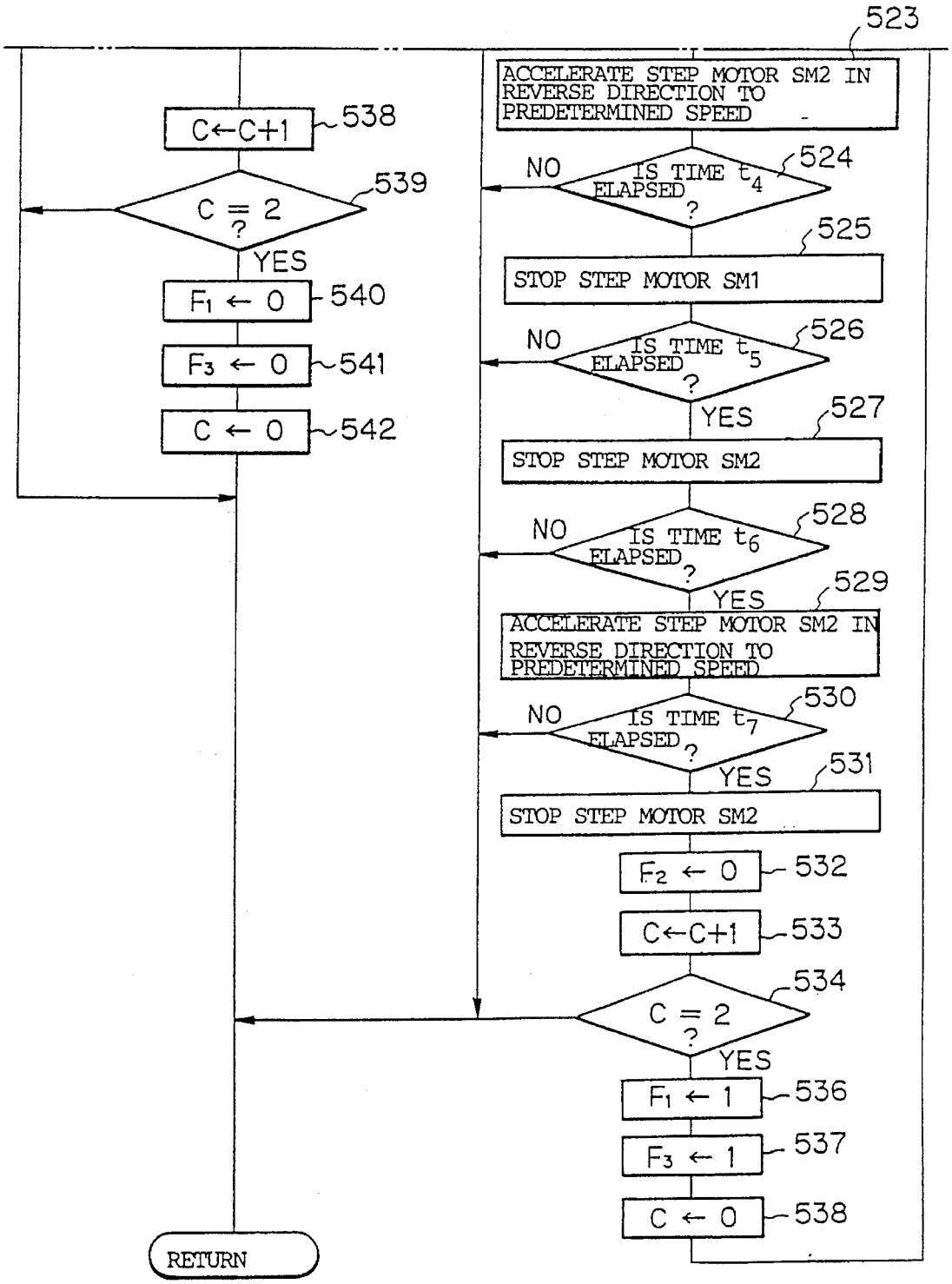
Figure 6:
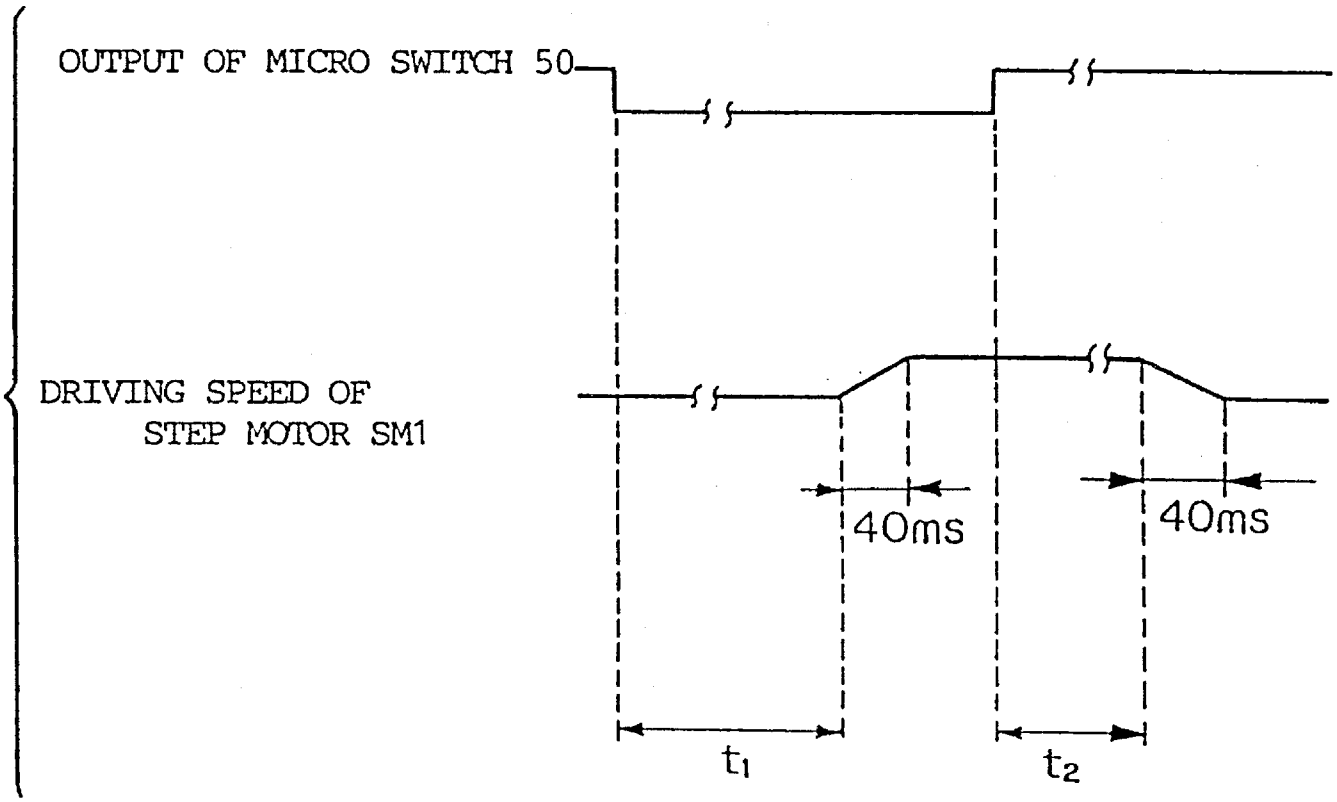
FIG. 6 is a timing chart in relation to the flow chart shown in FIGS. 5A and 5B.
Figure 7:
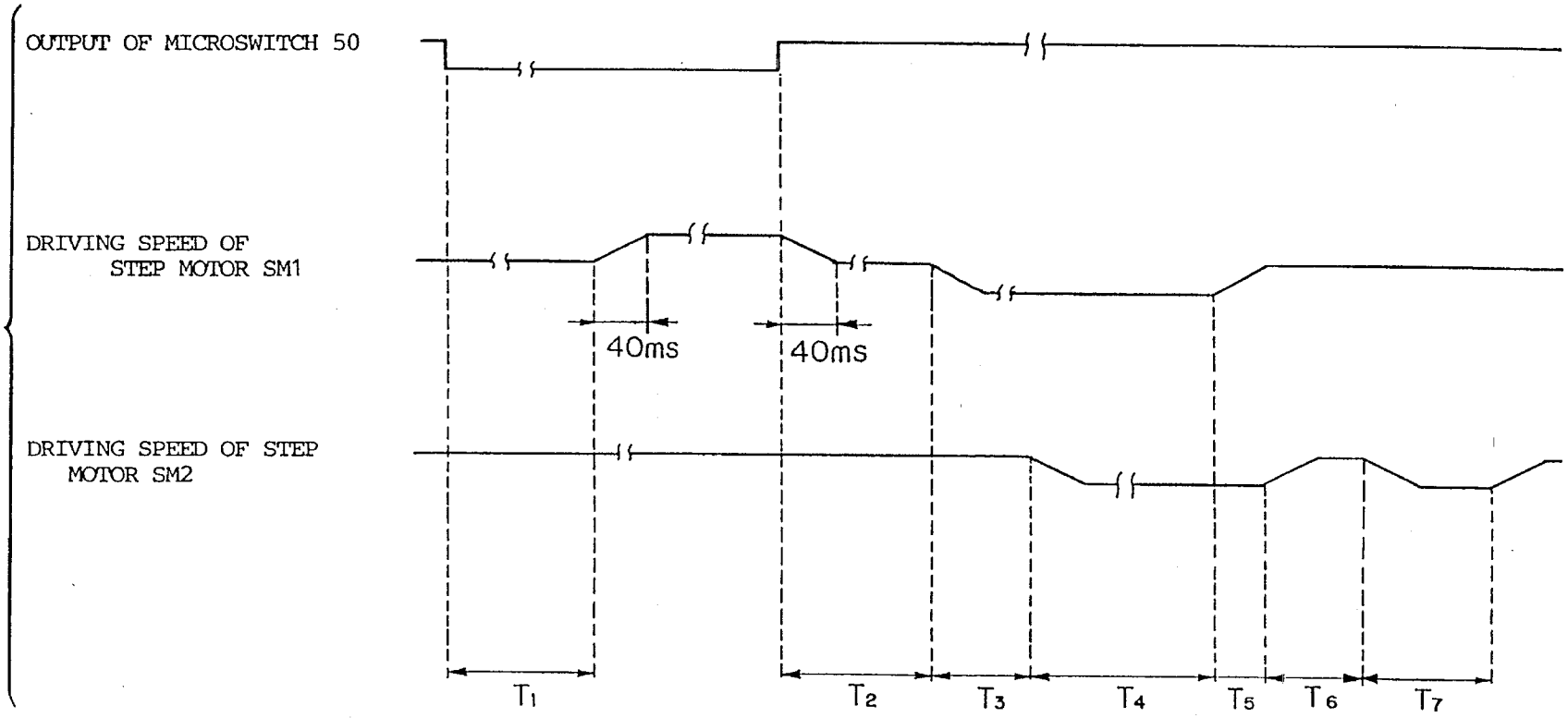
FIG. 7 is another timing chart in relation to the flow chart shown in FIGS. 5A and 5B.

FIGS. 5A and 5B show a routine for actuating the paper feeder according to the present invention; and FIG. 6 and FIG. 7 indicate timing charts in relation to the routine of FIGS. 5A and 5B. This routine is started by turning on the power switch 56 (FIG. 4) of the laser printer and is executed by an interruption signal output at a predetermined time interval, for example, at every 1 ms.

At step 501, it is decided whether or not the flag $F_1$ is "0". In an initial state, $F_1$=0, and therefore the routine goes to step 502, at which it is decided whether or not the flag BF is "0". The flag BF indicates whether one-sided printing should be carried out by the laser printer or whether two-sided printing should be carried out, and the writing of "0" or "1" to the flag BF is carried out by an instruction from a word processor or a personal computer connected to the laser printer. Namely, when BF=0, the one-sided printing is carried out, and when BF=1, the two-sided printing is carried out.

When the one-sided printing is carried out, that is, when BF=0 , the routine goes from step 502 to step 503. At step 503, it is decided whether or not the flag $F_2$ is "0". In the initial state, $F_2$=0, and therefore the routine goes to step 504, at which it is decided whether the output signal from the paper detector 50 (that is, the A/D converter 54) is the low level "L" or high level "H" (FIG. 6). When the output signal from the paper detector 50 is at the high level "H", that is, where the leading edge of the sheet paper ejected from the heat fixing unit 36 has not yet been detected by the paper detector 50, the routine is once ended.

After an elapse of 1 ms, the routine is executed again, but no progress is made until the leading edge of the sheet paper ejected from the heat fixing unit 36 is detected by the paper detector 50. Namely, at step 504, the detection of the leading edge of the sheet paper by the paper detector 50 is monitored.

When the output signal from the paper detector 50 is changed over from the high level "H" to the low level "L", that is, when the leading edge of the sheet paper ejected from the heat fixing unit 36 is detected by the paper detector 50, the routine goes from step 504 to 505, at which it is decided whether or not the time $t_1$ has elapsed. No progress is made so far as the time $t_1$ has not elapsed. The time $t_1$ is a time required for the leading edge of the sheet paper ejected from the heat fixing unit 36 to pass between the blade-equipped roller 26*a* of the paper switching unit 26 and the first side roller 26*b* and to reach a pair of paper feed rollers 38*a* and 38*b* from a point of time when it is detected by the paper detector 50. Note that, in the present embodiment, the time $t_1$ is 400 ms.

When the time $t_1$ has elapsed, the routine goes from step 505 to 506, at which the step motor SM1 is accelerated to a predetermined speed in the forward direction. At this time, the drive rollers 38*a*, 40*a*, and 42*a* are rotated at a circumferential speed of 133 mm/sec in the forward direction (clockwise direction), whereby the sheet paper is fed along the paper eject passageway 22 toward the outlet end thereof. Note that, as shown in FIG. 6, the acceleration of the step motor SM1 to the predetermined speed is carried out over a time of for example 40 ms.

At step 507, the flag $F_2$ is rewritten from "0" to "1", and subsequently the routine goes to step 508, at which it is decided whether the output signal from the paper detector 50 is the low level "L" or high level "H". Namely, at step 508, it is monitored whether or not the trailing edge of the sheet paper is detected by the paper detector 50.

At step 508, when the trailing edge of the sheet paper is detected by the paper detector 50, that is, when the output signal from the paper detector 50 is changed over from the low level "L" to the high level "H", the routine goes from step 508 to step 509, at which it is decided whether or not the time $t_2$ has elapsed (FIG. 6). The time $t_2$ is a time required for the trailing edge of the sheet paper to leave the pair of paper feed rollers 42*a* and 42*b* from a point of time when it is detected by the paper detector 50.

At step 509, when the time $t_2$ has elapsed, the routine goes to step 510, at which the drive of the step motor SM1 is decelerated and stopped (FIG. 6). The sheet paper leaving the pair of the paper feed rollers 42*a* and 42*b* is ejected onto the paper receiver 16 by a pair of paper eject rollers 44*a* and 44*b*. Note that, the deceleration time of the step motor SM1 is 40 ms, which is the same as the abovementioned acceleration time.

Subsequently, the routine goes to step 511, at which the flag $F_2$ is rewritten from "1" to "0", and then it is decided at step 512 whether or not the flag $F_3$ is "0". At the present time, $F_2$=0, and therefore the routine is once ended.

The above explained actuation is for performing the one-sided printing by a laser printer and is repeated whenever the sheet paper is ejected from the heat fixing unit 36.

Where the two-sided printing is carried out by the laser printer, that is, where "1" is written in the flag BF, the routine goes from step 502 to step 513, at which it is decided whether or not the flag $F_2$ is "0". At this point of time, $F_2$=0, and therefore the routine goes from step 513 to step 514, at which it is decided whether the output signal from the paper detector 50 is the low level "L" or the high level "H". When the output signal from the paper detector 50 is at the high level "H", that is, when the leading edge of the sheet paper ejected from the heat fixing unit 36 has not yet been detected by the paper detector 50, the routine is once ended.

After an elapse of 1 ms, the routine is executed again, but no progress is made until the leading edge of the sheet paper ejected from the heat fixing unit 36 is detected by the paper detector 50. Namely, at step 514, the detection of the leading edge of the sheet paper by the paper detector 50 is monitored.

When the output signal of the paper detector 50 is changed over from the high level "H" to the low level "L" (FIG. 7), that is, when the leading edge of the sheet paper ejected from the heat fixing unit 36 is detected by the paper detector 50, the routine goes from step 514 to 515, at which it is decided whether or not the time $T_1$ has elapsed. No progress is made so long as the time $T_1$ has not elapsed. The time $T_1$ is a time required for the leading edge of the sheet paper ejected from the heat fixing unit 36 to pass between the blade-equipped roller 26*a* and the first side roller 26*b* and to reach a pair of paper feed rollers 38*a* and 38*b* from a point of time when it is detected by the paper detector 50. Namely, the time $T_1$ is equal to the abovementioned time $t_1$ (400 ms).

When the time $T_1$ has elapsed, the routine goes from step 515 to 516, at which the step motor SM1 is accelerated to the predetermined speed in the forward direction (FIG. 7). At this time, the drive rollers 38*a*, 40*a*, and 42*a* are rotated at the circumferential speed of 133 mm/sec in the forward direction (clockwise direction), whereby the sheet paper is fed along the paper eject passageway 22 toward the outlet end thereof. Note that, as clear from FIG. 7, the acceleration time to the predetermined speed of the step motor SM1 is 40 ms.

At step 517, the flag $F_2$ is rewritten from "0" to "1", and subsequently the routine goes to step 518, at which it is decided whether the output signal from the paper detector 50 is the low level "L" or the high level "H". Namely, at step 518, it is monitored whether or not the trailing edge of the sheet paper is detected by the paper detector 50.

At step 518, when the trailing edge of the sheet paper is detected by the paper detector 50, that is, when the output signal from the paper detector 50 is changed over from the low level "L" to the high level "H", the routine goes to step 519, at which the driving operation of the step motor SM1 is decelerated and stopped. The deceleration time of the step motor SM1 is 40 ms as is apparent from FIG. 7. At this time, the trailing edge of the sheet paper stops at a position away from the detection portion by the paper detector 50 by only 5.4 mm. As clear from FIG. 3, in the present embodiment, the outer diameter of the blade-equipped roller 26*a* is 12 mm, and the horizontal distance from the detection portion by the paper detector 50 up to the vertical axial line passing through the center of the blade-equipped roller 26*a* is 2.4 mm. For this reason, the trailing edge of the sheet paper will stop at the position away from the vertical axial line passing through the center of the blade-equipped roller 26*a* by 3 mm on the eject direction side. Note that, in FIG. 3, "r" indicates the radius of the blade-equipped roller 26*a*.

Subsequently, when the routine goes to step 520, it is decided whether or not the time $T_2$ has elapsed. No progress is made so long as the time $T_2$ has not elapsed. The time $T_2$ is appropriately selected and set to a time within a range of from, for example, 59 through 270 ms. In short, the sheet paper is stopped only during a period of time $T_2$. At this time, the trailing edge of the sheet paper is directed to the paper bypass passageway 24 side by the blade-equipped roller 26*a*.

At step 520, when the time $T_2$ has elapsed, the routine goes to step 521, at which the step motor SM1 is accelerated to the predetermined speed in a reverse direction, whereby the sheet paper is fed toward the paper bypass passageway 24. In this case, the circumferential speed of the drive rollers 38*a*, 40*a*, and 42*a* is set to 133 mm/sec, and therefore the sheet paper is made to smoothly pass between the blade-equipped roller 26*a* and the second side roller 26*c*. Note that, the acceleration time of the step motor SM1 is 40 ms.

Subsequently, when the routine goes to step 522, it is decided whether or not the time $T_3$ has elapsed. No progress is made so long as the time $T_3$ has not elapsed. The time $T_3$ is a time required for the leading edge of the sheet paper to reach just before the paper feed rollers 46*a* and 46*b* provided in the paper bypass passageway 24 from a point of time when it is fed toward the paper bypass passageway 24.

At step 522, when the time $T_3$ has elapsed, the routine goes to step 523, at which the step motor SM2 is accelerated to the predetermined speed in the reverse direction, whereby the sheet paper is fed along the paper bypass passageway 24 toward a pair of register rollers 34*a* and 34*b*. Note that, the acceleration time of the step motor SM2 is 40 ms, and the circumferential speed of the drive rollers 46*a* and 48*b* is set to 133 mm/sec.

Subsequently, at step 524, it is decided whether or not the time $T_4$ has elapsed. No progress is made so long as the time $T_4$ has not elapsed. The time $T_4$ is a time required for the trailing edge of the sheet paper to leave from a pair of paper feed rollers 38*a* and 38*b* from a point of time when the step motor SM2 is accelerated.

At step 524, when the time $T_4$ has elapsed, the routine goes to step 525, at which the step motor SM1 is decelerated and stopped. Note that, the deceleration time of the step motor SM1 is 40 ms.

Subsequently, at step 526, it is decided whether or not the time $T_5$ has elapsed. No progress is made so long as the time $T_5$ has not elapsed. The time $T_5$ is a time required for the leading edge of the sheet paper to reach just before a pair of register rollers 34*a* and 34*b* from a point of time when the step motor SM1 is decelerated.

At step 526, when the time $T_5$ has elapsed, the routine goes to step 527, at which the step motor SM2 is decelerated and stopped. Note that, the deceleration time is 40 ms.

Subsequently, at step 528, it is decided whether or not the time $T_6$ has elapsed. No progress is made so long as the time $T_6$ has not elapsed. The time $T_6$ is a time required for the leading edge of the sheet paper to be introduced into the recording unit 14 by a pair of register rollers 34*a* and 34*b* from a point of time when the step motor SM2 is decelerated.

At step 528, when the time $T_6$ has elapsed, the routine goes to step 529, at which the step motor SM2 is accelerated in a reverse direction. Note that, the acceleration time of the step motor SM2 is 40 ms.

Subsequently, at step 530, it is decided whether or not the time $T_7$ has elapsed. No progress is made so long as the time $T_7$ has not elapsed. The time $T_7$ is a time required for the trailing edge of the sheet paper to leave from a pair of paper feed rollers 48*a* and 48*b* from a point of time when the step motor SM2 is accelerated at step 529.

At step 528, when the time $T_7$ has elapsed, the routine goes to step 531, at which the step motor SM2 is decelerated and stopped. Note that, the deceleration time is 40 ms.

In FIG. 2, reference symbol P1 indicates a sheet paper initially introduced into the recording unit 14 at the time of two-sided printing. The printing is applied to only one side of this sheet paper P1. Accordingly, so as to apply the printing to the other surface of the sheet paper P1, the sheet paper P1 must be fed along the paper bypass passageway 24 toward a pair of register rollers 34*a* and 34*b* as mentioned above. Note that, in FIG. 2, the sheet paper P1 fed along the paper bypass passageway 24 is indicated by a one dot chain line. In the present embodiment, due to an increase of the amount of the printing processing at the laser printer, during a period where the sheet paper P1 is fed from the paper eject passageway 22 toward the paper bypass passageway 24, a second sheet paper P2 has been already introduced into the recording unit 14, and the printing is applied to the other surface of the sheet paper P2 after the printing is applied to one side of the sheet paper P2. For this reason, in the present embodiment, the printing initially applied to the one side of the sheet paper P1 is carried out based on either of the printing data of first page and second page among the printing data held in the word processor or personal computer (for example the printing data of the second page), while the printing initially applied to one side of the sheet paper P2 is carried out based on either of the printing data of the third page and fourth page among the printing data (for example the printing data of the fourth page). Subsequently, where the printing is applied to the other surface of the sheet paper P1, the printing data of the first page is used, while where the printing is applied to the other surface of the sheet paper P2, the printing data of the third page is used. Where the printing is applied to the papers P1 and P2 in such a manner, the sheet papers P1 and P2 are ejected onto the paper receiving holder 16 in a proper order of pages. Note that, a printing mode as mentioned above is disclosed in detail in Japanese Unexamined Patent Publication (Kokai) No. 2-39966.

An explanation will be made again of the routine shown in FIG. 5.

After the step motor SM2 is decelerated at step 531, the routine goes to step 532, at which the flag $F_2$ is rewritten from "1" to "0". Subsequently, at step 533, the count value of the counter C is counted up exactly by +1. At step 534, it is decided whether or not the count value of the counter C is equal to "2". When C is not equal to 2, the routine is once ended.

Thereafter, when the second order sheet paper (P2) is returned to a pair of register rollers 34*a* and 34*b* for the two-sided printing in the same mode, since the value of the counter C has been brought to "2", the routine goes to step 535, at which the flag $F_1$ is rewritten from "0" to "1", and at step 536, also the flag $F_3$ is rewritten from "0" to "1". Subsequently, after the counter C is reset at step 537, it is returned to step 501.

At this time, $F_1$=1, and therefore the routine goes from step 501 to step 503, at which the above-mentioned sheet paper ejection actuation (step 504 through 512) is carried out, whereby an initial sheet paper (P1), that is, the sheet paper subjected to the two-sided printing, is ejected onto the paper receiving holder 16. On the other hand, the flag $F_3$=1 at this time, and therefore the routine goes from step 512 to step 538, at which the count value of the counter C is counted up exactly by +1. At step 539, it is decided whether or not the count value of the counter C is equal to "2". When C is not equal to "2", the routine is once ended.

Subsequently, a similar paper ejection actuation is repeated (step 504 through 512) for ejecting the second sheet paper (P2) onto the paper receiving holder 16. At this time, the value of the counter C has been brought to "2", and therefore the routine goes to step 540, at which the flag $F_1$ is rewritten from "1" to "0", and at step 541, also the flag $F_3$ is rewritten from "1" to "0". Subsequently, after the counter C is reset at step 542, the routine is once ended.

Further, when the two-sided printing is carried out also with respect to the third and fourth sheet paper, the feeding of these sheet papers is carried out by the same mode.

As apparent from the above description, according to the present invention, the paper eject passageway per se is utilized as the paper reversal and accommodating unit for reversing the sheet paper at the time of two-sided printing, and therefore it becomes unnecessary to provide such a paper reversal and accommodating unit in the paper bypass passageway. Accordingly, the paper feeder according to the present invention can contribute to the reduction of size of a recording apparatus such as a copier or printer constituted so as to be able to perform the two-sided recording.

Figure 8:
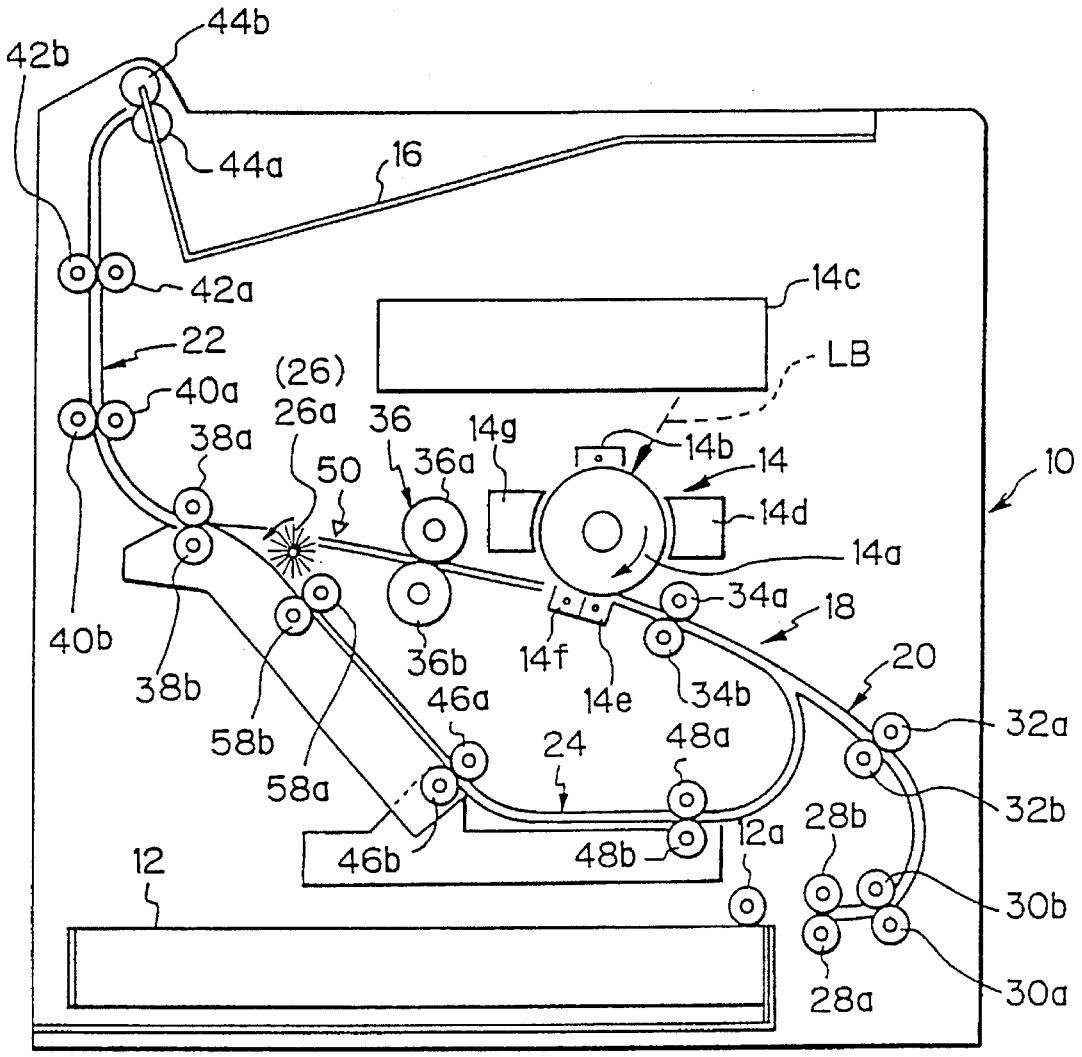
FIG. 8 is a schematic view of a laser printer in which is built a second embodiment of the paper feeder according to the present invention.
Figure 9:
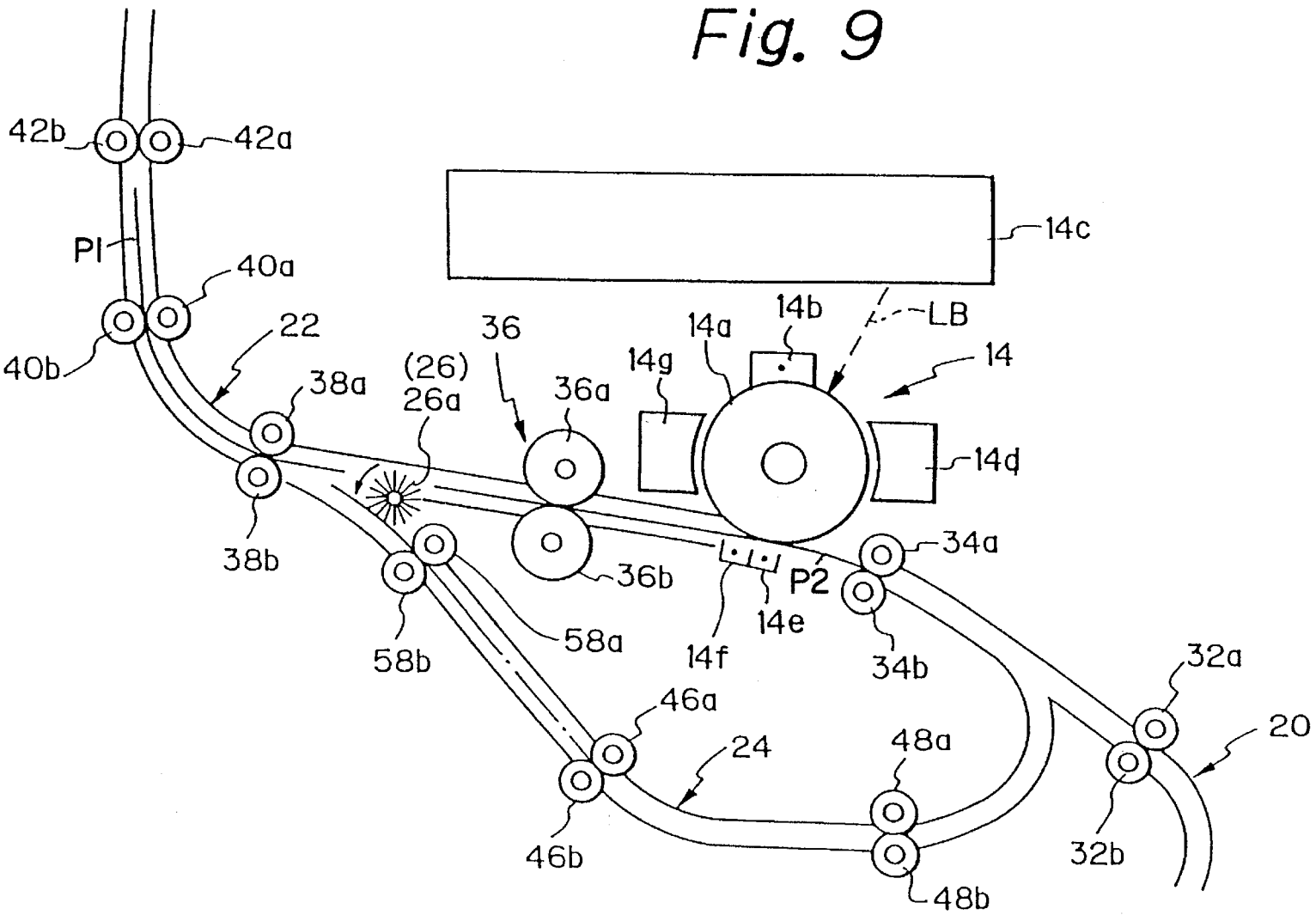
FIG. 9 is a partial enlarged view of the laser printer shown in FIG. 8.
Figure 10:
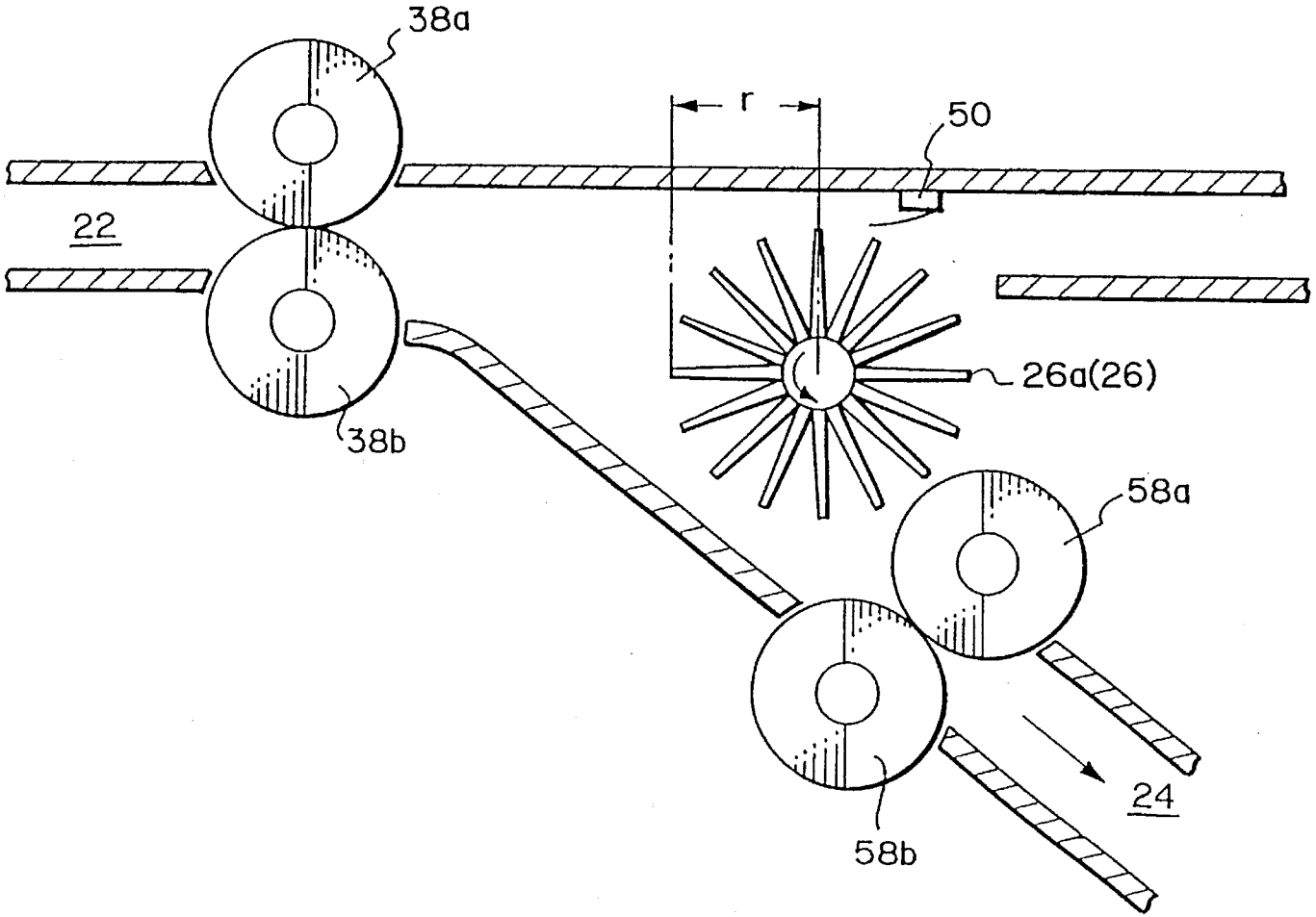
FIG. 10 is a partial enlarged view of the paper feeder shown in FIG. 9.

FIG. 8, FIG. 9, and FIG. 10 indicate a second embodiment of a paper feeder according to the present invention. Note that, in FIG. 8, FIG. 9, and FIG. 10, the same constituent elements as the constituent elements of the above-mentioned first embodiment are indicated by the same reference numerals. In the second embodiment, the paper switching means 26 comprises only the blade-equipped roller 26*a*. This blade-equipped roller 26*a* is rotated in the counterclockwise direction so that the circumferential speed thereof becomes faster than the usual feeding speed 133 mm/sec, for example, 672 mm/sec. Note that, during the actuation of the laser printer, the blade-equipped roller 26*a* is continuously being rotated. Also, in the second embodiment, in addition to the two pairs of the paper feed rollers 46*a* and 46*b* and rollers 48*a* and 48*b*, another pair of paper feed rollers 58*a* and 58*b* are installed in the paper bypass passageway 24, and in addition, arranged close to the blade-equipped roller 26*a*. The paper feed roller 58*a* is formed as the drive roller and is driven in the same way as the drive rollers 46*a* and 48*a* by the step motor SM2. Note that, the paper feed roller 58*b* is formed as the driven roller.

Figures 11, 11A:
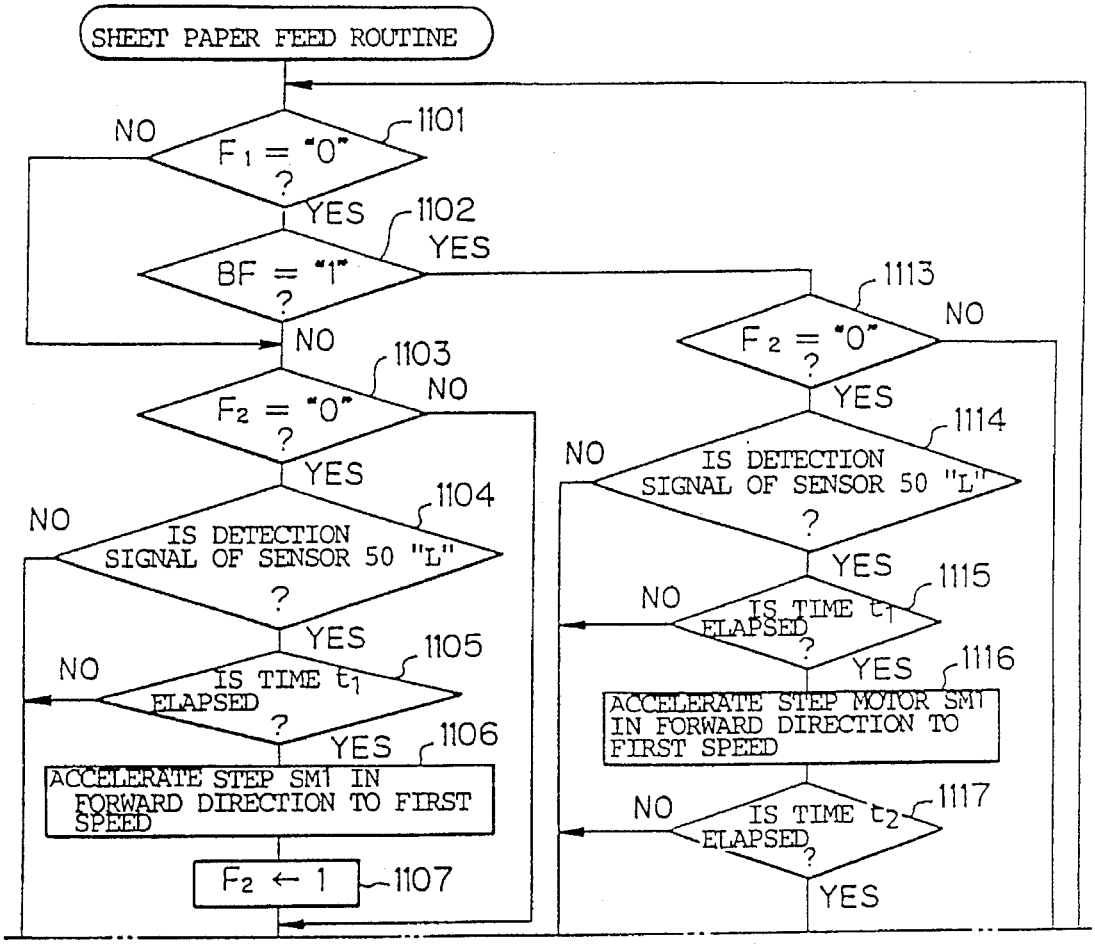
FIGS. 11, 11(A), 11(B) and 11(C) are a flow chart explaining the actuation of the paper feeder shown in FIG. 9.
Figure 11B:
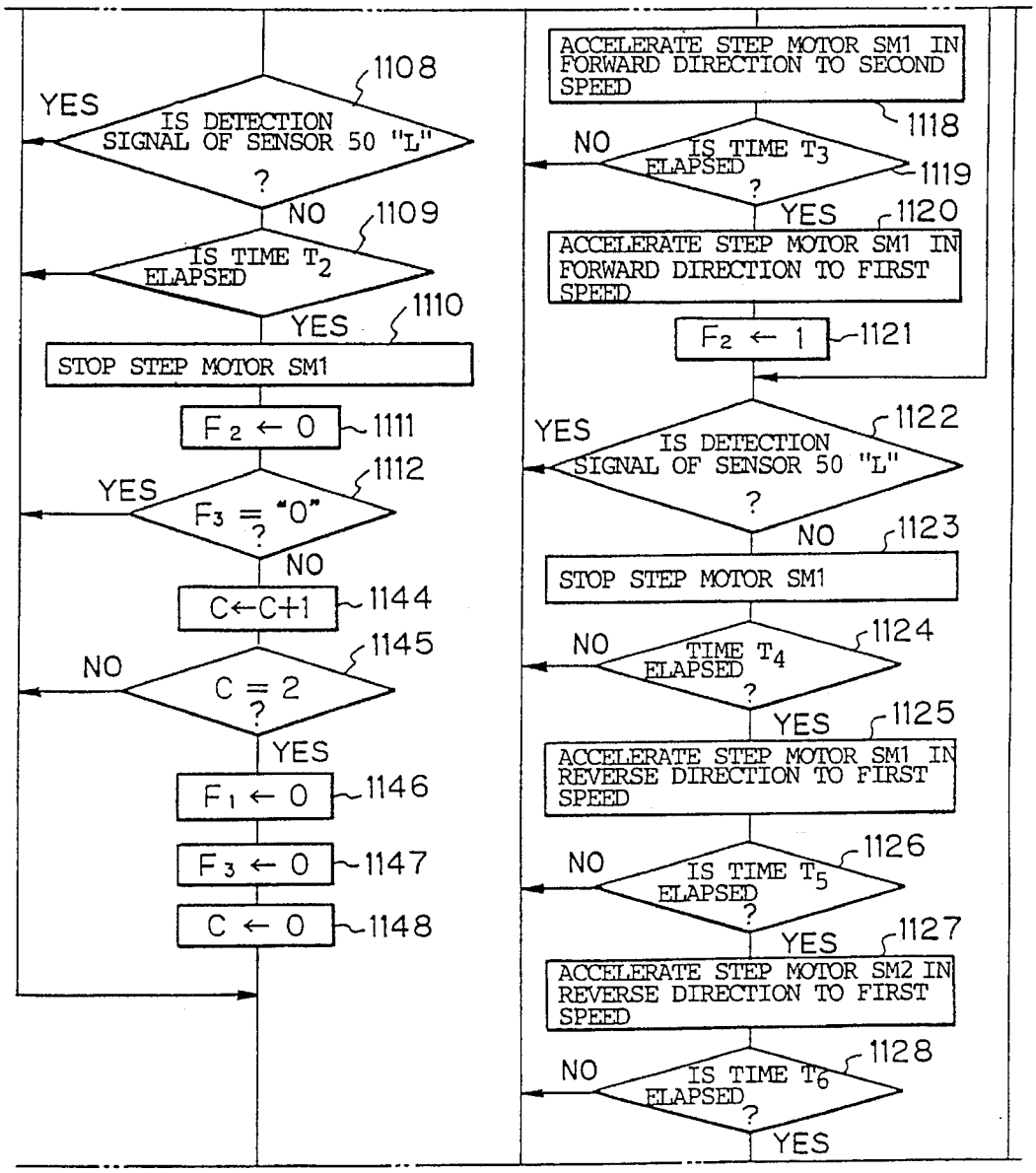
Figure 11C:
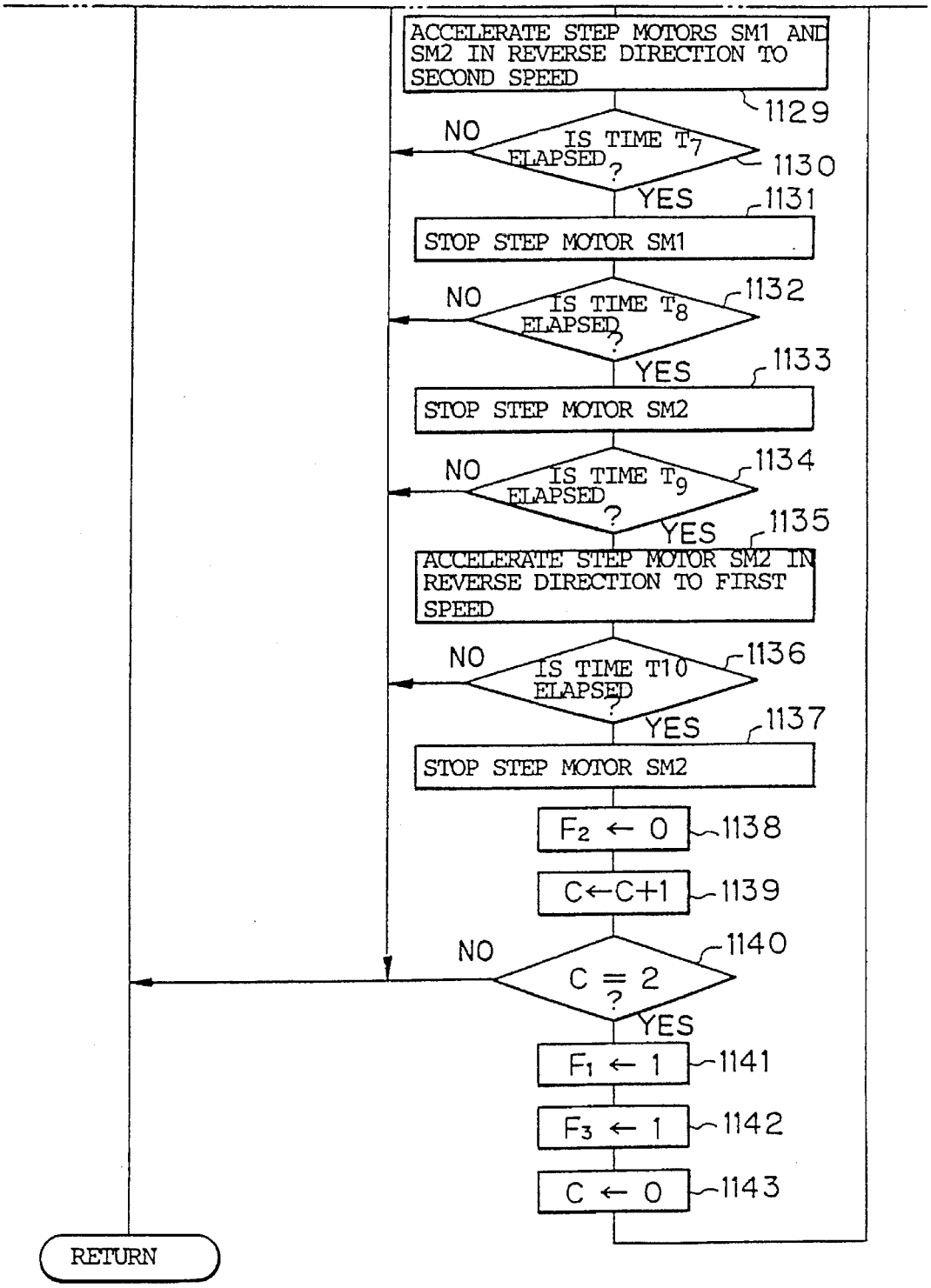
Figure 12:
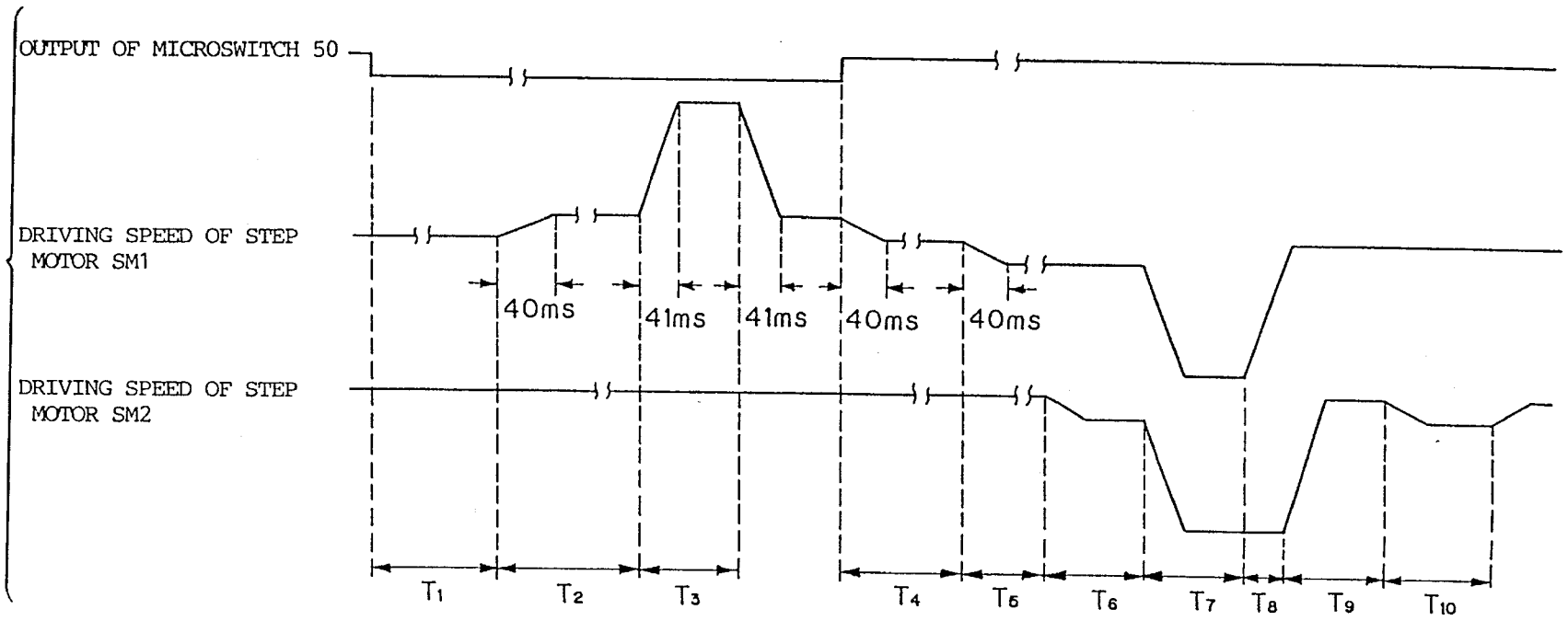
FIG. 12 is a timing chart in relation to the flowchart shown in FIGS. 11(A) to 11(C)
Figure 13A:
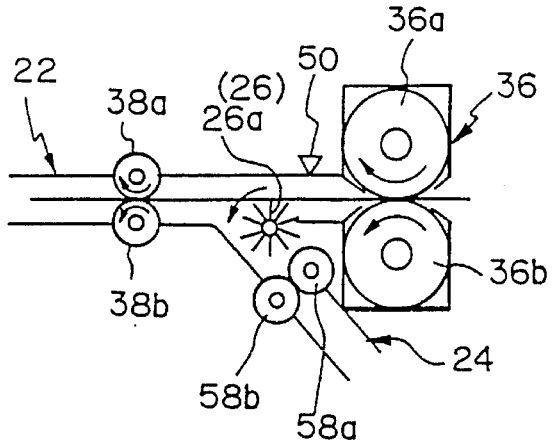
FIGS. 13(*a*) to 13(*d*) are an explanatory views used for an explanation of the flow chart shown in FIGS. 11(A) to 11(C)
Figure 13B:
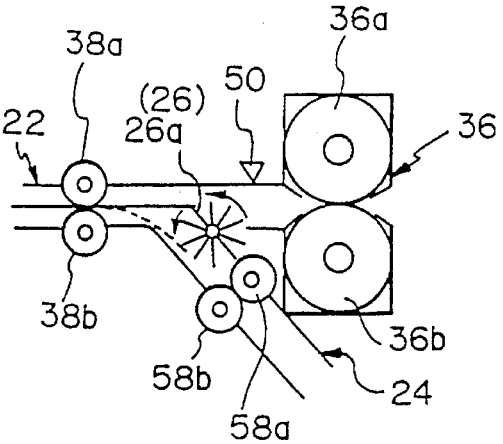
Figure 13C:
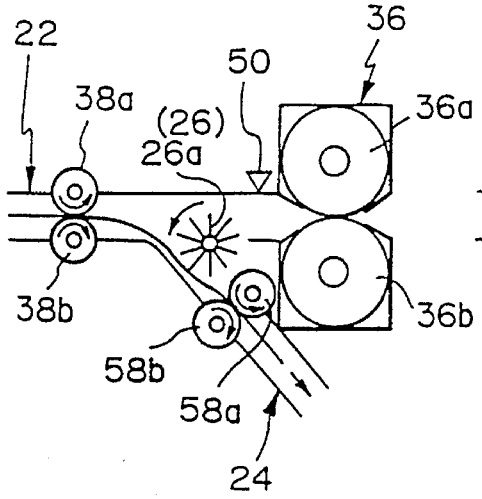
Figure 13D:
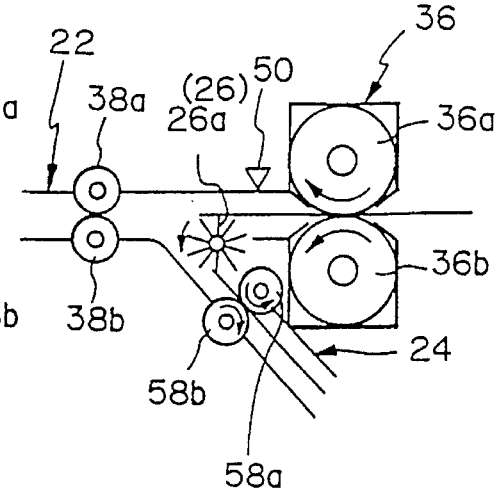

FIGS. 11(A)–11(C) shown a routine for actuating the paper feeder of the second embodiment; and FIG. 12 is a timing chart in relation to the routine of FIGS. 11(A)–11(C). In the same way as the routine shown in FIG. 5, also the routine of FIGS. 11(A)–11(C) is activated by turning on the power source switch 56 (FIG. 4) and is executed by the interruption signal output at a predetermined time interval, for example, at every 1 ms.

At step 1101, it is decided whether or not the flag $F_1$ is "0". In the initial state, $F_1$=0, and therefore the routine goes to step 1102, at which it is decided whether or not the flag BF is "0". In the same way as the case of the routine shown in FIG. 5, the flag BF indicates whether the one-sided printing should be carried out by the laser printer, or the two-sided printing should be carried out thereby, and the writing of "0" or "1" to the flag BF is carried out by the instruction from the word processor or personal computer connected to the laser printer. Namely, when BF=0, the one-sided printing is carried out, while when BF=1, the two-sided printing is carried out.

When the one-sided printing is carried out, the mode of feeding of the sheet paper is the same as the case of the routine of FIG. 5, and the sheet paper is ejected onto the paper receiving holder 16 according to the timing chart of FIG. 6. In short, steps 1101 through 1112 substantially coincide with steps 501 through 512 of FIG. 5.

Where the two-sided printing is carried out, that is, where "1" has been written in the flag BF, the routine goes from step 1102 to step 1113, at which it is decided whether or not the flag $F_2$ is "0". In the initial state, since $F_2$=0, the routine goes from step 1113 to step 1114, at which it is decided whether the output signal from the paper detector 50 is the low level "L" or the high level "H". When the output signal from the paper detector 50 is at the high level "H", that is, when the leading edge of the sheet paper ejected from the heat fixing unit 36 has not yet been detected by the paper detector 50, the routine is once ended.

After an elapse of 1 ms, the routine is executed again, but no progress is made until the leading edge of the sheet paper ejected from the heat fixing unit 36 is detected by the paper detector 50. Namely, at step 1114, the detection of leading edge of the sheet paper by the paper detector 50 is monitored.

When the output signal of the paper detector 50 is changed over from the high level "H" to low level "L" (FIG. 12), that is, when the leading edge of the sheet paper ejected from the heat fixing unit 36 is detected by the paper detector 50, the routine goes from step 1114 to 1115, at which it is decided whether or not the time $T_1$ has elapsed. No progress is made so long as the time $T_1$ has not elapsed. The time $T_1$ is a time required for the leading edge of the sheet paper ejected from the heat fixing unit 36 to pass the blade-equipped roller 26*a* and reach a pair of paper feed rollers 38*a* and 38*b* from when it is detected by the paper detector 50. Namely, the time $T_1$ is equal to the time $t_1$ mentioned previously (400 ms).

After an elapse of the time $T_1$, the routine goes from step 1115 to 1116, at which the step motor SM1 is accelerated to the first speed in the forward direction (FIG. 12). In this case, the drive rollers 38*a*, 40*a*, and 42*a* are rotated in the forward direction (clockwise direction) at the circumferential speed of 133 mm/sec, whereby the sheet paper is fed along the paper eject passageway 22 toward the outlet end thereof (FIG. 13(*a*)). The circumferential speed 133 mm/sec coincides with the usual feeding speed of the sheet paper in the same way as the case of the above-mentioned embodiment. Also, as clear from FIG. 12, the acceleration time of the step motor SM1 to the first speed is 40 ms.

At step 1117, it is decided whether or not the time $T_2$ has elapsed. No progress is made so long as the time $T_2$ has not elapsed. The time $T_2$ is a time required for the trailing edge of the sheet paper to leave from the heat fixing unit 36 from a point of time when the step motor SM1 starts to be accelerated to the first speed. Note that, in the present embodiment, the time $T_2$ is set to 700 ms.

At step 1117, when the time $T_2$ has elapsed, that is when the trailing edge of the sheet paper leaves the heat fixing unit 36, the routine goes to step 1118, at which the step motor SM 1 is accelerated to the second speed in the forward direction. At this time, the circumferential speed of the drive rollers 38*a*, 40*a*, and 42*a* is accelerated from 133 mm/sec to the circumferential speed of the blade-equipped roller 26*a*, i.e., 672 mm/sec, and therefore the sheet paper is fed along the paper eject passageway 22 at a high speed of 672 mm/sec without receiving resistance from the blade-equipped roller 26*a* toward the outlet end thereof. Note that, the acceleration time of the step motor SM1 from the first speed to the second speed is 41 ms, as apparent from FIG. 12.

Subsequently, at step 1119, it is decided whether or not the time $T_3$ has elapsed. No progress is made so long as the time $T_3$ has not elapsed. The time $T_3$ is a time required for the trailing edge of the sheet paper to reach just before the paper detector 50 from a point of time when the step motor SM1 starts to be accelerated to the second speed. Note that, in the present embodiment, the time $T_3$ is set to 85 ms.

At step 1119, when the time $T_3$ has elapsed, the routine goes to step 1120, at which the step motor SM1 is decelerated from the second speed to the first speed. Namely, the feeding speed of the sheet paper is decelerated from a high speed of 672 mm/sec to the usual speed 133 mm/sec. Note that, the deceleration time is the same as the acceleration time of the step motor SM1 from the first speed to the second speed, i.e., 41 ms.

At step 1121, the flag $F_2$ is rewritten from "0" to "1", and subsequently the routine goes to step 1122, at which it is decided whether the output signal from the paper detector 50 is the low level "L" or the high level "H". Namely, at step 1122, it is monitored whether or not the trailing edge of the sheet paper is detected by the paper detector 50.

At step 1122, when the trailing edge of the sheet paper is detected by the paper detector 50, that is, when the output signal from the paper detector 50 is changed over from the low level "L" to the high level "H", the routine goes to step 1123, at which the driving operation of the step motor SM1 is decelerated and stopped. The deceleration time of the step motor SM1 is 40 ms as apparent from FIG. 12, and at this time the trailing edge of the sheet paper stops at a position away from the detection portion by the paper detector 50 by only 5.4 mm in the same way as the case of FIG. 3. Note that, also in the present embodiment, the outer diameter of the blade-equipped roller 26*a* is 12 mm, and a horizontal distance from the detection portion by the paper detector 50 to the vertical axial line passing through the center of the blade-equipped roller 26*a* is 2.4 mm. Accordingly, in the same way as the case of FIG. 3, the trailing edge of the sheet paper is stopped at a position away from the vertical axial line passing through the center of the blade-equipped roller 26*a* by 3 mm on the ejection direction side (FIG. 13(*b*)).

Subsequently, when the routine goes to step 1124, it is decided whether or not the time $T_4$ has elapsed. No progress is made so long as the time $T_4$ has not elapsed. The time $T_4$ is appropriately selected and set to within a range of for example 59 through 270 ms. In short, the sheet paper is stopped only during a period $T_4$ and at this time, the trailing edge of the sheet paper is directed to the paper bypass passageway 24 side by the blade-equipped roller 26*a* as indicated by a broken line in FIG. 13(*b*).

At step 1124, when the time $T_4$ has elapsed, the routine goes to step 1125, at which the step motor SM1 is accelerated to the first speed in the reverse direction, whereby the sheet paper is fed along the paper bypass passageway 24. At this time, the circumferential speed of the drive rollers 38*a*, 40*a*, and 42*a* is set to 133 mm/sec, and therefore also the feeding speed of the sheet paper fed along the paper bypass passageway 24 becomes 133 mm/sec. When the sheet paper is fed along the paper bypass passageway 24, the sheet paper immediately passes the position of deployment of the blade-equipped roller 26*a*, but the circumferential speed of the blade-equipped roller 26*a* is set to 672 mm/sec, and therefore the sheet paper fed along the paper bypass passageway 24 will not receive any resistance from the blade-equipped roller 26*a*. Note that, as shown in FIG. 12, the acceleration time of the step motor SM1 in the reverse direction is 40 ms.

Subsequently, when the routine goes to step 1126, it is decided whether or not the time $T_5$ has lapsed. No progress is made so long as the time $T_5$ has not elapsed. The time $T_5$ is a time required for the leading edge of the sheet paper to reach just before the paper feed rollers 58*a* and 58*b* provided in the paper bypass passageway 24 from a point of time when the sheet paper starts to be fed toward the paper bypass passageway 24. Note that, in the present embodiment, $T_5$ is 100 ms.

At step 1126, when the time $T_5$ has elapsed, the routine goes to step 1127, at which the step motor SM2 is accelerated to the first speed in the reverse direction, and at this time, the circumferential speed of the drive rollers 58*a*, 46*a*, and 48*a* is set to 133 mm/sec. Accordingly, the sheet paper fed at the feeding speed of 133 mm/sec can be smoothly accepted by the paper feed rollers 48*a* and 48*b* installed in the paper bypass passageway 24 (FIG. 13(*c*)).

Subsequently, when the routine goes to step 1128, it is decided whether or not the time $T_6$ has elapsed. No progress is made so long as the time $T_6$ has not elapsed. The time $T_6$ is a time appropriately set from a point of time when the step motor SM2 starts to be accelerated to the second speed in the reverse direction and is set to for example 200 ms in the present embodiment.

At step 1128, when the time $T_6$ has elapsed, the routine goes to step 1129, at which the step motors SM1 and SM2 are accelerated from the first speed to the second speed in the reverse direction. At this time, the circumferential speed of the drive rollers 38*a*, 40*a*, and 42*a* installed in the paper eject passageway 22 and the drive rollers 58*a*, 46*a*, and 48*a* installed in the paper bypass passageway 24 is set to 672 mm/sec. Accordingly, the sheet paper is fed at a high speed of 672 mm/sec along the paper bypass passageway 24 toward a pair of register rollers 34*a* and 34*b*.

Subsequently, at step 1130, it is decided whether or not the time $T_7$ has elapsed. No progress is made so long as the time $T_7$ has not elapsed. The time $T_7$ is a time required for the trailing edge of the sheet paper to leave from a pair of paper feed rollers 38*a* and 38*b* from a point of time when the step motors SM1 and SM2 are accelerated from the first speed to the second speed.

At step 1130, when the time $T_7$ has elapsed, the routine goes to step 1131, at which the step motor SM1 is decelerated and stopped. At this time, as shown in FIG. 13(*d*), the sheet paper is completely removed from the paper eject passageway 22, and therefore a state of readiness for accepting the second sheet paper is entered.

Subsequently, at step 1132, it is decided whether or not the time $T_8$ has elapsed. No progress is made so long as the time $T_8$ has not elapsed. The time $T_8$ is a time required for the leading edge of the sheet paper to reach just before a pair of register rollers 34*a* and 34*b* from a point of time when the step motor SM1 is decelerated from the second speed to the first speed.

At step 1132, when the time $T_8$ has elapsed, the routine goes to step 1133, at which the step motor SM2 is decelerated and stopped.

Subsequently, at step 1134, it is decided whether or not the time $T_9$ has elapsed. No progress is made so long as the time $T_9$ has not elapsed. The time $T_9$ is a time required for the leading edge of the sheet paper to be introduced into the recording unit 14 by a pair of register rollers 34*a* and 34*b* from a point of time when the step motor SM2 is decelerated.

At step 1134, when the time $T_9$ has elapsed, the routine goes to step 1135, at which the step motor SM2 is accelerated in the reverse direction.

Subsequently, at step 1136, it is decided whether or not the time $T_{10}$ has elapsed. No progress is made so long as the time $T_{10}$ has not elapsed. The time $T_{10}$ is a time required for the trailing edge of the sheet paper to leave from a pair of paper feed rollers 48*a* and 48*b* from a point of time when the step motor SM2 is accelerated at step 1135.

At step 1136, when the time $T_{10}$ has elapsed, the routine goes to step 1137, at which the step motor SM2 is decelerated and stopped.

In the same way as in FIG. 2, also in FIG. 9, reference symbol P1 indicates the sheet paper initially introduced into the recording unit 14 at the time of two-sided printing, and reference symbol P2 indicates a second sheet paper introduced into the recording unit 14 during a period when the sheet paper P1 is fed from the paper eject passageway 22 toward the paper bypass passageway 24. In the above-mentioned second embodiment, when the first sheet paper P1 is fed from the paper eject passageway 22 to the paper bypass passageway 24, the feeding speed thereof is partially high (627 mm/sec), and therefore it is possible to make the interval between the sheet paper P1 and sheet paper P2 narrower in comparison with that in the first embodiment, and therefore the amount of printing processing at the printing unit 14 is increased compared with the first embodiment.

Subsequently, the routine goes to step 1138, at which the flag $F_2$ is rewritten from "1" to "0". Subsequently, at step 1139, the count value of the counter C is counted up exactly by +1, and at step 1140, it is decided whether or not the count value of the counter C is equal to "2". When C is not equal to 2, the routine is once ended.

Thereafter, when the second sheet paper (P2) is returned to a pair of register rollers 34*a* and 34*b* for the two-sided printing in the same mode, the value of the counter C has been changed to "2", and therefore the routine goes to step 1141, at which the flag $F_1$ is rewritten from "0" to "1", and at step 1142, also the flag $F_3$ is rewritten from "0" to "1". Subsequently, after the counter C is reset at step 1143, it is returned to step 1101.

At this time, since $F_1=1$, the routine goes from step 1101 to step 1103, at which the paper ejection actuation (steps 1104 through 1112) at the time of one-sided printing is performed, whereby the first sheet paper (P1), that is, the sheet paper subjected to the two-sided printing, is ejected onto the paper receiving holder 16. On the other hand, the flag $F_3$ is made equal to 1 at this time, and therefore the routine goes from step 1112 to step 1144, at which the count value of the counter C is counted up exactly by +1. At step 1145, it is decided whether or not the count value of the counter C is equal to "2". When C is not equal to "2", the routine is once ended.

Subsequently, a similar paper ejection actuation is repeated (steps 1104 through 1112) for ejecting the second sheet paper (P2) onto the paper receiving holder 16. At this time, the value of the counter C has been brought to "2", and therefore the routine goes to step 1140, at which the flag $F_1$ is rewritten from "1" to "0", and at step 1141, also the flag $F_3$ is rewritten from "1" to "0". Subsequently, after the counter C is reset at step 1137, the routine is once ended.

Further, when the two-sided printing is carried out also with respect to the third and fourth sheet papers, the feeding of these sheet papers can be carried out in the same mode.

Figure 14:
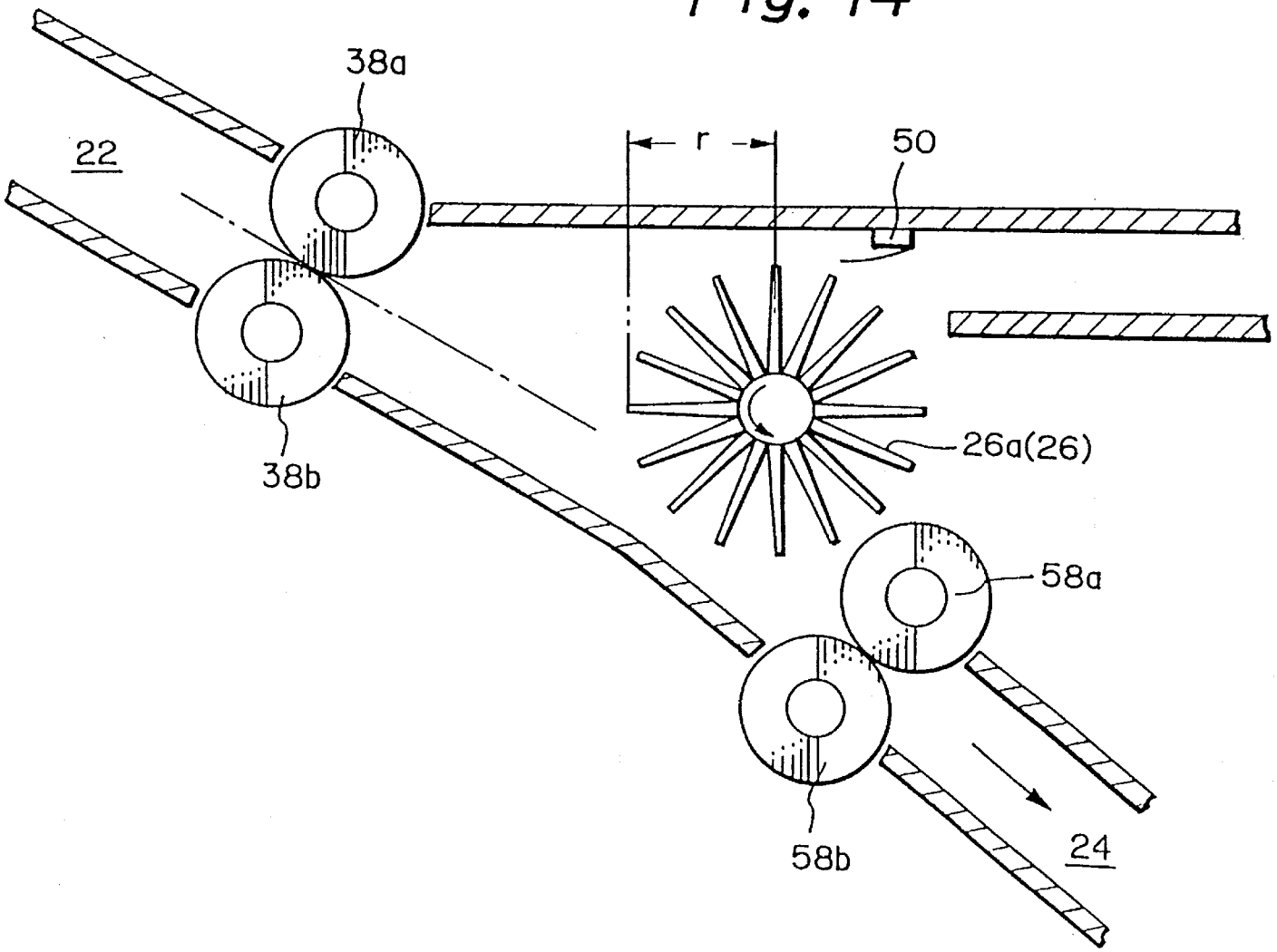
FIG. 14 is a partial enlarged view corresponding to FIG. 10 and is a view indicating a modified embodiment of the second embodiment of the paper feeder according to the present invention.

FIG. 14 indicates a modified embodiment of the above-mentioned second embodiment. In this modified embodiment, a pair of paper feed rollers 38*a* and 38*b* installed in the paper eject passageway 22 are directed so that the tangential line defined therebetween goes toward the paper bypass passageway 24. According to such an arrangement, when the sheet paper is brought to a stopped state so as to be fed from the paper eject passageway 22 toward the paper bypass passageway 24 (step 1124), it is possible to more smoothly direct the trailing edge of the sheet paper to the paper bypass passageway 24 side.

Figure 15:
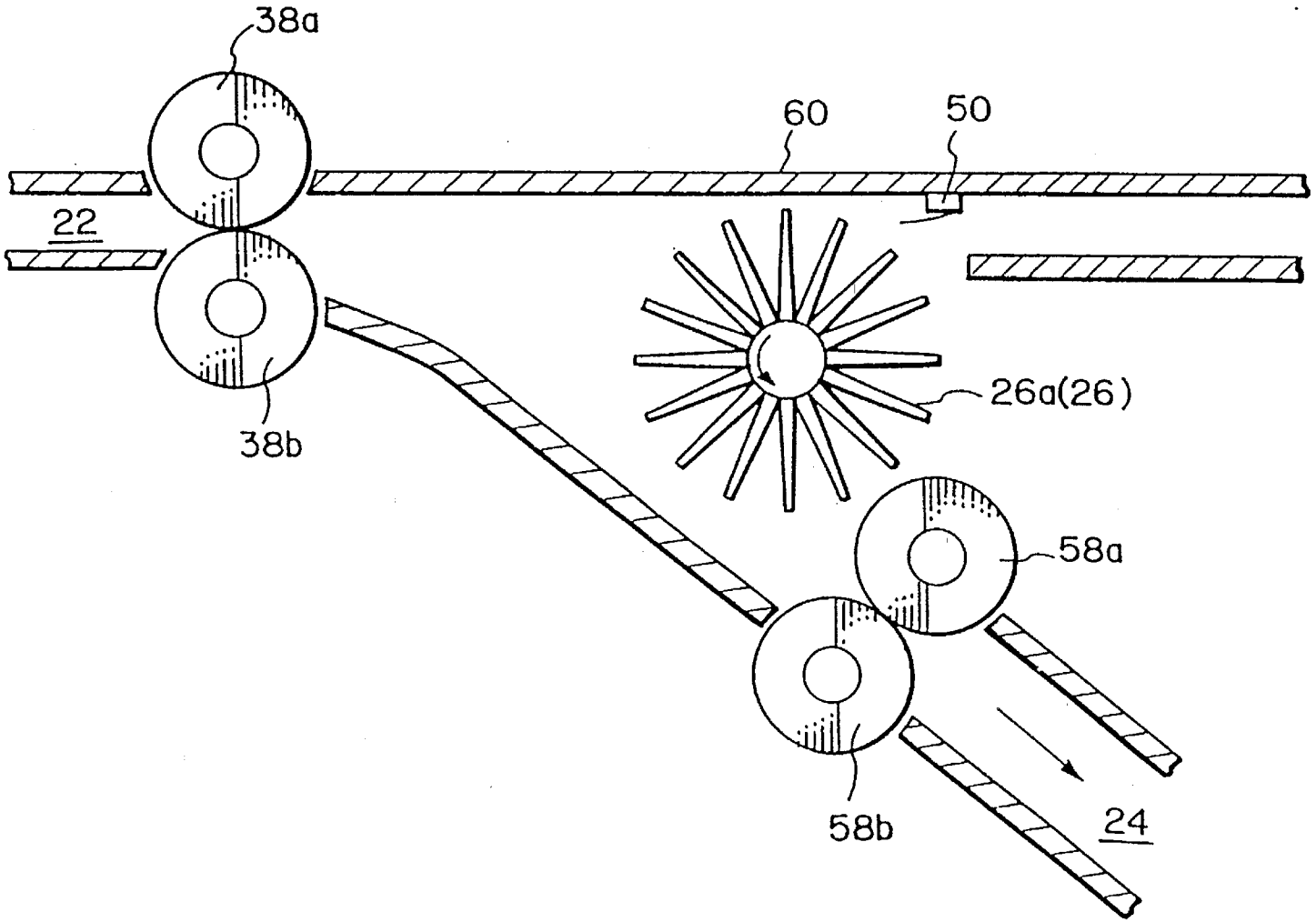
FIG. 15 is a partial enlarged view corresponding to FIG. 10 and is a view indicating another modified embodiment of the second embodiment of the paper feeder according to the present invention.

FIG. 15 indicates another modified embodiment of the above-mentioned second embodiment. In this modified embodiment, the upper guide plate 60 forming the paper eject passageway 22 is arranged close to the blade-equipped roller 26*a*, and therefore when the sheet paper ejected from the heat fixing unit 36 passes between the blade-equipped roller 26*a* and the upper guide plate paper 60, a tension is given to the sheet paper. This is because the circumferential speed of the blade-equipped roller 26*a* is set to 627 mm/sec while the sheet paper is fed at a feeding speed of 133 mm/sec. Immediately after the sheet paper is ejected from the heat fixing unit 36, wrinkles frequently occur in the sheet paper, or the sheet paper is bent or deformed. In this case, when the sheet paper is returned to the recording unit 14 for the two-sided printing, the transfer of the charged toner to such a sheet paper is not carried out well in certain cases. In the modified embodiment shown in FIG. 15, the tension is given to the sheet paper ejected from the heat fixing unit 36, and therefore wrinkles or bending or deformation occurred there can be removed.

We claim:

1. A paper feeder installed in a recording apparatus so as to be able to selectively perform two-sided recording on a sheet paper, said paper feeder comprising:

paper supply passageway means for supplying the sheet paper to a recording unit of the recording apparatus;

paper eject passageway means for ejecting from said recording unit the sheet paper on which the recording is performed at the recording unit of the recording apparatus;

paper bypass passageway means which extends between the paper supply passageway means and the paper eject passageway means;

paper switching means provided at a branched portion between the paper eject passageway means and the paper bypass passageway means; and paper feed roller means which can be driven to rotate in forward and reverse directions, provided in said paper eject passageway means whereby the sheet paper can be fed in forward and reverse directions along the paper eject passageway means, wherein the paper feed roller means is arranged on the downstream side of the paper switching means in the ejection direction of the sheet paper; and wherein after the sheet paper on which recording has been performed on one side at the recording unit of the recording apparatus is once fed along the paper eject passageway means by the forward direction driving operation of the paper feed roller means, the sheet paper is fed to the paper bypass passage means through the paper bypass switching means by the reverse direction driving operation of said paper feed roller means, whereby the reversal of said sheet paper is carried out, wherein a portion of said paper eject passageway means positioned on the downstream side of said branched portion and adjacent thereto is arranged so as to form a continuous straight passageway together with a portion of said paper bypass passageway means adjacent to said branched portion; and wherein another portion of said paper eject passageway means positioned on the upstream side of said branched portion and adjacent thereto is angularly arranged with respect to the portion of said paper eject passageway means positioned on the downstream side of said branched portion, and wherein the paper switching means comprises a blade-equipped roller element arranged at the branched portion between the paper eject passageway means and the paper bypass passageway means; and the circumferential speed of the blade-equipped roller element is greater then the normal feeding speed of the sheet paper.

2. A paper feeder as set forth in claim 1, wherein control for change-over of the paper feed roller means from the forward direction driving operation to the reverse direction driving operation is carried out based on the detection of the passing of the sheet paper at an appropriate position of the paper eject passageway means by a sheet paper detection means installed at said appropriate position.

3. A paper feeder as set forth in claim 1, wherein the forward direction driving operation of the paper feed roller means is carried out based on the detection of the passing of the sheet paper at an appropriate position of the paper eject passageway means by the sheet paper detection means installed at said appropriate position.

4. A paper feeder as set forth in claim 1, wherein the reverse direction driving operation of the paper feed roller means is carried out based on the detection of the passing of the sheet paper at the appropriate position of the paper eject passageway means by the sheet paper detection means installed at said appropriate position.

5. A paper feeder as set forth in claim 1, wherein the paper switching means comprises a roller assembly, which roller assembly includes a blade-equipped roller element, arranged at the branched portion between the paper eject passageway means and the paper bypass passageway means, and two side roller elements which are engaged with the blade-equipped roller element and are arranged on respective sides of said paper eject passageway means and said paper bypass passageway means; and wherein the rotation direction of the blade-equipped roller element is reversed with respect to the rotation direction of the side roller elements, the circumferential speed of the three roller elements being substantially equal to the normal feeding speed of the sheet paper.

6. A paper feeder as set forth in claim 1, wherein the paper switching means comprises a blade-equipped roller element arranged at the branched portion between the paper eject passageway means and the paper bypass passageway means; and the circumferential speed of the blade-equipped roller element is greater than the normal feeding speed of the sheet paper.

7. A paper feeder as set forth in claim 1, wherein the feeding direction of said sheet paper is directed toward said paper bypass passageway means when the sheet paper is fed to the paper bypass passageway means by the paper feed roller means by its reverse direction driving operation.

8. A paper feeder installed in a recording apparatus so as to be able to selectively perform two-sided recording on a sheet paper, said paper feeder comprising:

paper supply passageway means for supplying the sheet paper to a recording unit of the recording apparatus;

paper eject passageway means for ejecting from said recording unit the sheet paper on which the recording is performed at the recording unit of the recording apparatus;

paper bypass passageway means which extends between the paper supply passageway means and the paper eject passageway means;

paper switching means provided at a branched portion between the paper eject passageway means and the paper bypass passageway means;

paper feed roller means which can be driven to rotate in forward and reverse directions whereby the sheet paper can be fed along the paper eject passageway means in two directions provided in the paper eject passageway means, wherein said paper feed roller means is arranged on the downstream side of the paper switching means in the ejection direction of the sheet paper, wherein when the sheet paper on which recording has been performed on one side at the recording unit of the recording apparatus at the time of two-sided printing is once fed along the paper eject passageway means by the forward direction driving operation of the paper feed roller means, it is fed through the paper switching means to the paper bypass passageway means by the reverse direction driving operation of said paper feed roller means, whereby the reversal of said sheet paper is carried out, and the reverse direction driving operation of the paper feed roller means is controlled so that the feeding speed of said sheet paper is higher than the usual feeding speed thereof over at least a part of a period where the sheet paper is fed to the paper bypass passageway means through the paper switching means by the reverse direction driving operation of the paper feed roller means, and wherein the paper switching means comprises a blade-equipped roller element arranged at the branched portion between the paper eject passageway means and the paper bypass passageway means; and the circumferential speed of the blade-equipped roller element is greater then the normal feeding speed of the sheet paper.

9. A paper feeder as set forth in claim 8, wherein control for change-over of the paper feed roller means from the forward direction driving operation to the reverse direction driving operation is carried out based on the detection of the passing of the sheet paper at an appropriate position of the paper eject passageway means by a sheet paper detection means installed at said appropriate position.

10. A paper feeder as set forth in claim 8, wherein the forward direction driving operation of the paper feed roller means is controlled so that the feeding speed of said sheet paper becomes higher than the usual feeding speed thereof over at least a part of a period where the sheet paper on which recording has been performed on one side at the recording unit of the recording apparatus at the time of two-sided recording is once fed along the paper eject passageway means by the forward direction driving operation of the paper feed roller means.

11. A paper feeder as set forth in claim 10, wherein the forward direction driving control of the paper feed roller means is carried out based on the detection of the passing of the sheet paper at an appropriate position of the paper eject passageway means by the sheet paper detection means installed at said appropriate position.

12. A paper feeder as set forth in claim 10, wherein the paper switching means comprises a roller assembly, which roller assembly includes a blade-equipped roller element, arranged at the branched portion between the paper eject passageway means and the paper bypass passageway means, and two side roller elements which are engaged with the blade-equipped roller element and are arranged on respective sides of said paper eject passageway means and said paper bypass passageway means; and wherein the rotation direction of the blade-equipped roller element is reversed with respect to the rotation direction of the side roller elements, the circumferential speed of these three roller elements being substantially equal to the usual feeding speed of the sheet paper.

13. A paper feeder as set forth in claim 12, wherein the paper switching means comprises a blade-equipped roller element arranged at the branched portion between the paper eject passageway means and the paper bypass passageway means; and the circumferential speed of the blade-equipped roller element is greater than the usual feeding speed of the sheet paper.

14. A paper feeder as set forth in claim 8, wherein the reverse direction driving operation of the paper feed roller means is controlled so that the feeding speed of said sheet paper is higher than the usual feeding speed thereof over at least a part of a period where the sheet paper is fed to the paper bypass passageway means through the paper switching means by the reverse direction driving operation of the paper feed roller means.

15. A paper feeder as set forth in claim 8, wherein the reverse direction driving control of the paper feed roller means is carried out based on the detection of the passing of the sheet paper at the appropriate position of the paper eject passageway means by the sheet paper detection means installed at said appropriate position.

16. A paper feeder as set forth in claim 8, wherein the paper switching means comprises a blade-equipped roller element arranged at the branched portion between the paper eject passageway means and the paper bypass passageway means; and the circumferential speed of the blade-equipped roller element is greater than the normal feeding speed of the sheet paper.

17. A paper feeder as set forth in claim 8, wherein the peripheral portion of the blade-equipped roller element is projected into the paper eject passageway means and arranged close to a guide plate element forming said paper eject passageway means, whereby a tension is given to said sheet element when the sheet element passes between the blade-equipped roller element and the guide plate element along the paper eject passageway means.

* * * * *

UNITED STATES PATENT AND TRADEMARK OFFICE

CERTIFICATE OF CORRECTION

PATENT NO. : 5,513,840

DATED : May 7, 1996

INVENTOR(S) : Nobuo FUJITA et al.

It is certified that error appears in the above-indentified patent and that said Letters Patent is hereby corrected as shown below:

Col. 4, line 1, change "FIGS. 11, 11(A), 11(B)" to --FIGS. 11(A), 11(B)--.

Col. 7, line 20, change "level "L" to --level "L" to the high level "H."--.

Signed and Sealed this

Sixteenth Day of July, 1996

*Attest:*

Bruce Lehman

BRUCE LEHMAN

*Attesting Officer*

*Commissioner of Patents and Trademarks*